US009346646B2

(12) United States Patent
Tsuji et al.

(10) Patent No.: US 9,346,646 B2
(45) Date of Patent: May 24, 2016

(54) IMAGE FORMING APPARATUS AND IMAGE FORMING SYSTEM

(71) Applicant: CANON KABUSHIKI KAISHA, Tokyo (JP)

(72) Inventors: Hiroharu Tsuji, Numazu (JP); Masayoshi Fukatsu, Suntou-gun (JP); Yohei Suzuki, Mishima (JP); Genki Takahashi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/684,194

(22) Filed: Apr. 10, 2015

(65) Prior Publication Data

US 2015/0298934 A1 Oct. 22, 2015

(30) Foreign Application Priority Data

Apr. 16, 2014 (JP) ..... 2014-084714
Mar. 12, 2015 (JP) ..... 2015-050066

(51) Int. Cl.

*B65H 31/24* (2006.01)
*B65H 39/02* (2006.01)
*B65H 31/02* (2006.01)
*B65H 31/30* (2006.01)
*B65H 7/20* (2006.01)
(Continued)

(52) U.S. Cl.

CPC ..... *B65H 31/24* (2013.01); *B65H 7/20* (2013.01); *B65H 29/58* (2013.01); *B65H 31/02* (2013.01); *B65H 31/3081* (2013.01); *B65H 39/02* (2013.01); *G03G 15/6552* (2013.01); *B65H 2301/4212* (2013.01); *B65H 2301/4213* (2013.01); *B65H 2301/42266* (2013.01); *B65H 2402/443* (2013.01); *B65H 2403/41* (2013.01); *B65H 2404/632* (2013.01); *B65H 2405/332* (2013.01); *B65H 2405/3311* (2013.01); *B65H 2408/111* (2013.01); *B65H 2511/412* (2013.01); *B65H 2511/51* (2013.01); *B65H 2511/515* (2013.01); *B65H 2513/514* (2013.01); *B65H 2701/182* (2013.01); *B65H 2801/06* (2013.01); *G03G 15/6529* (2013.01); *G03G 2215/00088* (2013.01); *G03G 2215/00299* (2013.01); *G03G 2215/00421* (2013.01); *G03G 2215/00438* (2013.01); *G03G 2215/00586* (2013.01); *G03G 2215/00603* (2013.01)

(58) Field of Classification Search

CPC ..... B65H 31/24; B65H 31/3081; B65H 7/20; B65H 2402/443; B65H 2301/42266; B65H 2405/3311

See application file for complete search history.

(56) References Cited

U.S. PATENT DOCUMENTS 5,722,650 A * 3/1998 Yamamoto et al. ..... 270/58.02
5,774,778 A * 6/1998 Adachi et al. ..... 399/403
(Continued)

FOREIGN PATENT DOCUMENTS

JP 4-121361 A 4/1992
JP 7-125909 A 5/1995
JP 2013-220905 A 10/2013

*Primary Examiner* — Patrick Cicchino
(74) *Attorney, Agent, or Firm* — Canon USA, Inc. IP Division

(57) ABSTRACT

An image forming apparatus includes an apparatus main body, an image forming unit, a storage portion, a moving unit, a stack portion, and a conveyance unit, wherein if the storage portion can store the sheet, the conveyance unit conveys the sheet on which the image has been formed to the storage portion, and if the storage portion cannot store the sheet, the image forming apparatus transitions to a standby state and waits for a discharge instruction, and when the discharge instruction is received, the conveyance unit conveys the sheet on which the image has been formed to the stack portion.

19 Claims, 18 Drawing Sheets

(51) Int. Cl.
*B65H 29/58* (2006.01)
*G03G 15/00* (2006.01)

(56) References Cited

U.S. PATENT DOCUMENTS 5,836,579 A * 11/1998 Hayashi et al. ..... 270/58.16
5,839,048 A * 11/1998 Kato ..... 399/407
6,076,825 A * 6/2000 Kato et al. ..... 271/207
6,085,913 A * 7/2000 Aiko et al. ..... 209/540
8,096,553 B2 * 1/2012 Obuchi et al. ..... 271/298
8,332,065 B2 * 12/2012 Kurakata ..... 700/217
8,672,324 B2 * 3/2014 Ikarashi ..... 271/279
8,833,767 B2 * 9/2014 Lu ..... 271/302
8,955,836 B2 * 2/2015 Jones ..... 271/207
2015/0102556 A1 * 4/2015 Tsuji et al. ..... 271/279

* cited by examiner

IMAGE FORMING APPARATUS AND IMAGE FORMING SYSTEM

BACKGROUND

1. Field

Aspects of the present invention generally relate to an image forming apparatus including a storage portion that temporarily stores a sheet on which an image has been formed.

2. Description of the Related Art

Conventionally, some image forming apparatuses, such as copy machines and printers, each include a storage portion that temporarily stores sheets in the apparatus so that a user can pick up only the user's own sheet on which an image has been formed.

Japanese Patent Application Laid-Open No. 2013-220905 discusses an image forming apparatus including a plurality of storage portions, each of which temporarily stores in the apparatus a sheet on which an image has been formed, in addition to a discharge tray that is usually shared by a plurality of users, provided on top of the apparatus main body. When a user wants to pick up a sheet stored in this storage portion, user authentication is performed using an identification (ID) card. User authentication is performed by the user causing an ID card reader provided in the apparatus to read the ID card of that user. When user authentication is successfully performed, the image forming apparatus is instructed to discharge the sheet, and thus the sheet of the user that has provided a discharge instruction of the sheet is discharged from the apparatus. Thus, the user can pick up only the user's own sheet on which an image has been formed. This configuration eliminates the need for a user to find out the user's own sheet in the discharge tray that stores both the user's own sheet and sheets of other users.

An apparatus including storage portions therein, such as one discussed in Japanese Patent Application Laid-Open No. 2013-220905, has an upper limit in the number of sheets that can be stored in the storage portions. Moreover, since user authentication using an ID card is required to pick up a sheet stored in a storage portion, other persons different from the user that has provided a print instruction of the sheet cannot pick up that user's sheet. Accordingly, if a user forgets to pick up the user's sheet from a storage portion after all of the storage portions have stored sheets, another user will not thereafter be able to use any storage portion. Japanese Patent Application Laid-Open No. 7-125909 discusses an apparatus that, in such a case, automatically discharges a sheet to a discharge tray usually shared by a plurality of users. However, discharge to such a discharge tray as discussed in Japanese Patent Application Laid-Open No. 7-125909 may result in mixed storage of both a sheet of a specific user and sheets of other users.

SUMMARY

Aspects of the present invention are generally directed to an image forming apparatus that allows a user to pick up the user's own sheets at one time even when storage portions can no longer store sheets.

According to an aspect of the present invention, an image forming apparatus includes an apparatus main body having an opening portion, an image forming unit configured to form an image on a sheet, a storage portion configured to store, in the apparatus main body, the sheet on which the image has been formed, a moving unit configured to move the sheet stored in the storage portion, and to stop the sheet in a protruded state in which a part of the sheet protrudes out of the apparatus main body through the opening portion, a stack portion configured to stack a sheet on which the image has been formed, and having been conveyed outside of the apparatus main body without passing through the storage portion, and a conveyance unit configured to convey the sheet on which the image has been formed to either the storage portion or the stack portion, wherein, if the storage portion can store the sheet, the conveyance unit conveys the sheet on which the image has been formed to the storage portion, and wherein, if the storage portion cannot store the sheet, the image forming apparatus transitions to a standby state and waits for a discharge instruction, and in a case where the discharge instruction is received in the standby state, the conveyance unit conveys the sheet on which the image has been formed to the stack portion.

Further features of the present disclosure will become apparent from the following description of exemplary embodiments with reference to the attached drawings.

DESCRIPTION OF THE EMBODIMENTS

In a first exemplary embodiment, the sheet discharge destination is changed based on a user instruction if a print instruction is provided while the storage portion has no available storage space. A description of the first exemplary embodiment will be described below in detail with reference to the drawings.

(Configuration Diagram of Image Forming Apparatus)

Figure 1:
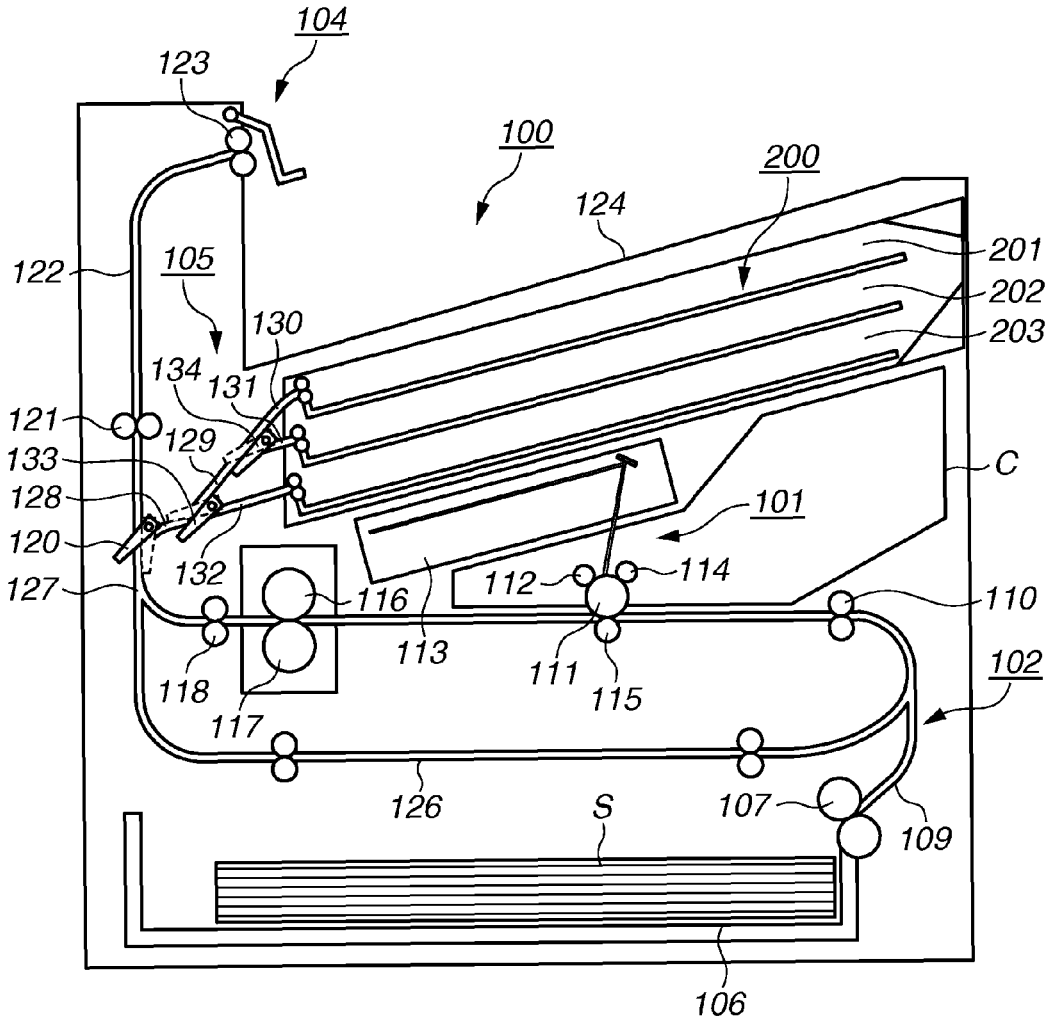
FIG. 1 is a diagram illustrating a configuration of an image forming apparatus according to an exemplary embodiment.

FIG. 1 is a diagram illustrating a configuration of an image forming apparatus including storage portions according to the first exemplary embodiment. The present exemplary embodiment uses a laser beam printer as an example of the image forming apparatus.

The image forming apparatus 100 includes an image forming unit 101, a supplying unit 102 that supplies a sheet S to the image forming unit 101, and a discharge unit 104 that discharges the sheet S, on which an image has been formed by the image forming unit 101. As used herein, a sheet S is one on which an image is formed by the image forming apparatus 100. Examples of a sheet S include a paper sheet, an overhead projector (OHP) sheet, and a fabric sheet. The image forming apparatus 100 further includes, above the image forming unit 101, a storage device 200 having a plurality of storage portions 201 to 203, each of which temporarily stores a sheet S on which an image has been formed, in the apparatus. The image forming apparatus 100 further includes conveyance unit 105 that conveys a sheet S on which an image has been formed, to the storage device 200.

The image forming unit 101 includes a photosensitive drum 111 that rotates in a clockwise (CW) direction in FIG. 1, a charging roller 112 that applies an electrical charge to a surface of the photosensitive drum 111, and an exposure unit 113 that emits light to the photosensitive drum 111 to form an electrostatic latent image. The image forming unit 101 further includes a development unit 114 that applies toner to the electrostatic latent image to form a toner image on the photosensitive drum 111, and a transfer roller 115 that transfers the toner image to the sheet S conveyed thereto. The image forming unit 101 still further includes a fixing roller 116, a pressing roller 117 in contact with the fixing roller 116, and a fixing/discharge roller 118, and thereby fixes on the sheet S the toner image that has been transferred to the sheet S. Such an electrophotographic image forming process allows the image forming unit 101 to form a toner image on the sheet S. In the image forming apparatus 100 according to the present exemplary embodiment, the photosensitive drum 111, the charging roller 112, the development unit 114, and a toner storage unit (not illustrated) that stores the toner are integrated as a cartridge C, which is detachable from the main body of the image forming apparatus 100. When toner has been consumed, the user can replace the cartridge C with a new cartridge C. Thus, the user can maintain the apparatus without the aid of a serviceperson. Note that the present disclosure is not limited to an image forming apparatus 100 of such a cartridge type, but is also directed to an image forming apparatus 100 configured in such a manner that components such as the photosensitive drum 111, the charging roller 112, and the development unit 114 are fixedly installed in the image forming apparatus 100 (i.e., one not requiring component replacement).

The supplying unit 102 includes a sheet cassette 106 that stores in a stack a plurality of sheets S used for image formation, a supply roller 107, a conveyance guide 109, and a registration roller 110.

The discharge unit 104 includes a first switching member 120, a conveyance roller 121, a discharge guide 122, a discharge roller 123, and a discharge tray 124 (stack portion). The first switching member 120 can be switched between a position indicated by a solid line in FIG. 1 for directing the sheet S after image formation to the storage device 200, and a position indicated by a broken line for directing the sheet S to the discharge tray 124 by means of an actuator (not illustrated). The discharge tray 124 is provided on top of the image forming apparatus 100, and can be shared by a plurality of users. Sheets are discharged to the discharge tray 124, and are then stacked thereon in such a manner that the surfaces on which an image has been formed (front surfaces) face downward (face-down). A double-sided conveyance path 126 is provided between the image forming unit 101 and the sheet cassette 106. The double-sided conveyance path 126 is used when an image is to be formed on each of the front and the back surfaces of a sheet S. An operation to form an image on each side of a sheet S is as follows. After an image is fixed on one surface (i.e., front surface) of the sheet S, the sheet S is conveyed toward the discharge tray 124. Then, after the rear edge of the sheet S passes a branch point 127, the conveyance roller 121 and the discharge roller 123 are rotated in a reverse direction. In this way, the sheet S is conveyed backward to the double-sided conveyance path 126. Passing the sheet S again through the image forming unit 101 can form an image also on the other surface (i.e., back surface) of the sheet S.

The conveyance unit 105 includes a second switching member 133 and a third switching member 134 to switch the conveyance destination of a sheet S, and conveyance guides 128 to 132 that guide the sheet S to an appropriate one of the storage portions 201 to 203. The second switching member 133 and the third switching member 134 each can be switched between the position indicated by the solid line and the position indicated by the broken line in FIG. 1 by means of an actuator (not illustrated). For example, when a sheet S is to be conveyed to the first storage portion 201, the second switching member 133 and the third switching member 134 are respectively positioned to the positions indicated by the solid lines in FIG. 1. The sheet S passes through the conveyance guide 128, and the conveyance guides 129 and 130 sequentially, and is then conveyed to the storage portion 201. When a sheet S is to be conveyed to the second storage portion 202, only the third switching member 134 is switched to the position indicated by the broken line. In this case, the sheet S passes through the conveyance guides 128, 129, and 131 sequentially, and is then conveyed to the storage portion 202. Similar to the case of the discharge tray 124, a sheet S is also stored face-down in the storage portions 201 to 203.

(Configuration Diagram of Storage Unit)

Figure 2:
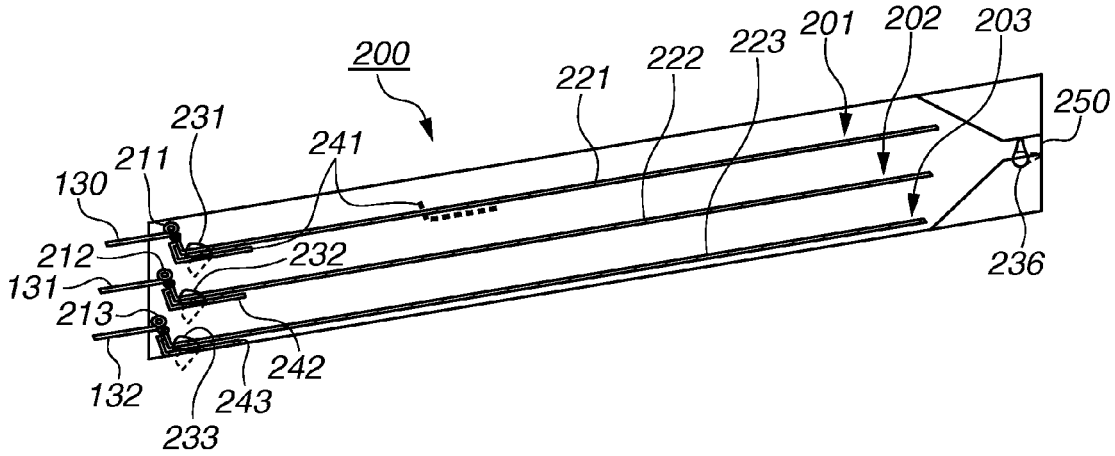
FIG. 2 is a diagram illustrating a configuration of a storage unit according to an exemplary embodiment.

FIG. 2 is a diagram illustrating a configuration of the storage device 200. In the storage device 200 according to the present exemplary embodiment, the plurality of storage portions 201 to 203 is vertically arranged. Since the configurations of the storage portions 201 to 203 are identical, the configuration of the first storage portion 201 will be described below.

The storage portion 201 includes a conveyance roller 211 for conveying a sheet S, a stacking tray 221 for stacking and temporarily storing therein the sheet S, and a sheet presence sensor 231 that detects whether a sheet S is stored in the stacking tray 221. The storage portion 201 further includes sheet-moving member 241 that presses a rear edge of each sheet S (i.e., an upstream edge of each sheet S in the conveyance direction) stored in the storage portion 201 to protrude a part of each stored sheet S out of the image forming apparatus 100. The sheet-moving member 241 moves a sheet S to a position where the user can pick up the sheet S, that is, until a front edge of the sheet S (i.e., a downstream edge of the sheet S in the conveyance direction) passes through an opening portion 250. This allows a predetermined length of the sheet S to protrude out of the image forming apparatus 100. The present exemplary embodiment assumes that the predetermined length of the sheet S to be protruded out of the image forming apparatus 100 is 30 mm. However, this predetermined length is merely an example, and may be any length as long as the user can take the protruding sheet S, and the sheet S does not largely bend down.

The stacking tray 221 has a length of which the front edge of a sheet S having a maximum size that can be stored in the storage portion 201 will not protrude through the opening portion 250. When a sheet S is placed on the tray 221, and the placed sheet S declines the sheet presence sensor 231 to the position indicated by the broken line, the sheet presence sensor 231 transitions to an ON state. When the sheet S is moved by the sheet-moving member 241, and the sheet presence sensor 231 returns to the position indicated by the solid line, the sheet presence sensor 231 transitions to an OFF state. Moreover, when the front edge of the moved sheet S declines an aperture sensor 236, provided near the opening portion 250, to the position indicated by the broken line, the aperture sensor 236 transitions to an ON state. When the sheet S protruding out of the image forming apparatus 100 is removed, and the aperture sensor 236 returns to the position indicated by the solid line, the aperture sensor 236 transitions to an OFF state. During sequential conveyance of sheets S to the storage portion 201, the sheet-moving member 241 is positioned at a stacking position indicated by the solid line. On the other hand, when a stored sheet S is to be protruded, the sheet-moving member 241 can move toward the opening portion 250 along the conveyance direction of the sheet S to a protruding position indicated by the broken line. The location of the protruding position, that is, the distance of movement of the sheet-moving member 241, is determined depending on the protrusion length of the sheet S and on the size of the sheet S in the conveyance direction.

Figure 3:
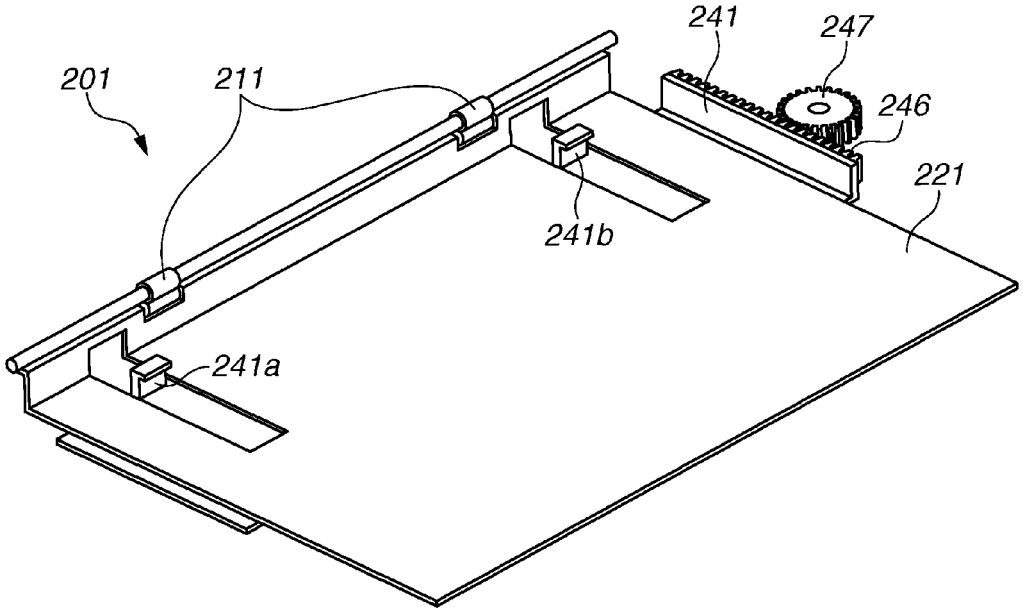
FIG. 3 is a perspective view of a storage portion according to an exemplary embodiment.

FIG. 3 is a perspective view of the storage portion 201. In FIG. 3, the sheet-moving member 241 is positioned between the stacking position and the protruding position. The sheet-moving member 241 has two sheet rear edge push devices 241*a* and 241*b* in a width direction of a sheet S. Furthermore, the sheet-moving member 241 monolithically includes a rack 246. The rack 246 engages with a pinion 247. The pinion 247 is connected to an actuator, which is a drive source not illustrated in FIG. 3. Driving the actuator in a normal and a reverse directions allows the sheet-moving member 241 to reciprocate between the stacking position and the protruding position.

(Block Diagram of Control Unit and Functional Configuration)

Figure 4:
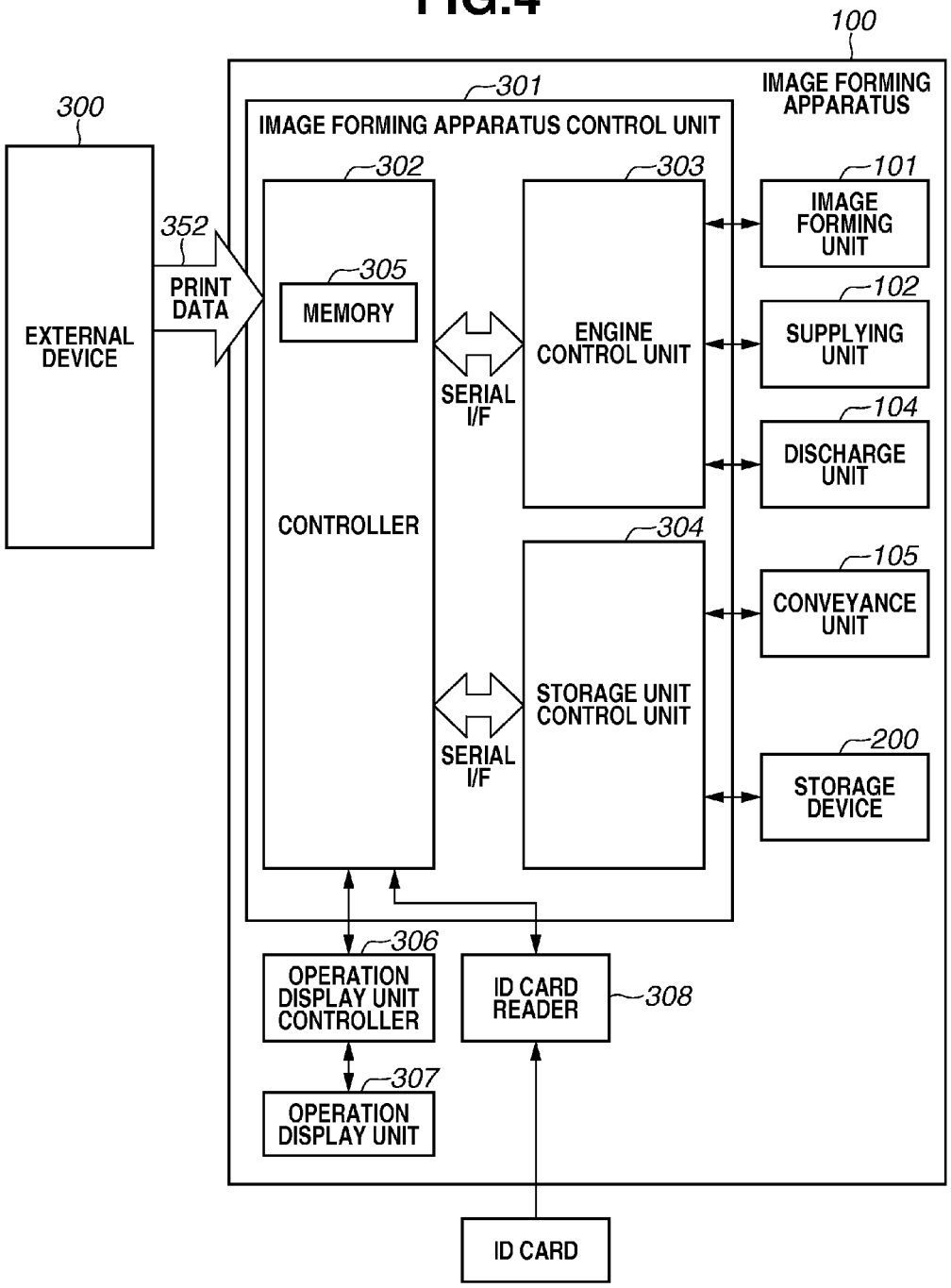
FIG. 4 is a block diagram illustrating a control unit and a functional configuration of an image forming apparatus according to an exemplary embodiment.

FIG. 4 is a block diagram illustrating a control unit and a functional configuration according to the present exemplary embodiment. The image forming apparatus 100 includes an image forming apparatus control unit 301 as a control unit. The image forming apparatus control unit 301 includes a controller 302, an engine control unit 303, and a storage unit control unit 304.

The controller 302 communicates with an external device 300, such as a host computer, to receive print data 352, and stores the received print data 352 in a memory 305 (e.g., a random access memory (RAM)). The controller 302 analyzes the print data 352 stored in the memory 305 to generate a set of print conditions. As used herein, print conditions include information representing the number of sheets S to be supplied, the discharge destination (the discharge tray 124 or the storage device 200) of a sheet S on which an image has been formed, the image density of printing, and the like. The controller 302 then designates the set of print conditions generated from the print data 352 to the engine control unit 303 through a serial interface (I/F). The engine control unit 303 controls mechanisms according to the set of print conditions received from the controller 302. More specifically, the engine control unit 303 controls the image forming unit 101 to form an image on a sheet S, and controls the supplying unit 102 and the discharge unit 104 to respectively supply and discharge a sheet S.

The controller 302 also analyzes the print data 352 stored in the memory 305 to generate a set of storage conditions and a set of discharge conditions for each of the storage portions 201 to 203. The controller 302 then designates the set of storage conditions and the set of discharge conditions generated from the print data 352 to the storage unit control unit 304 through a serial I/F. As used herein, the storage conditions include information representing the storage destination of a sheet S on which an image has been formed, the number of sheets S to be stored, and the like. The discharge conditions include information representing the distances to move the sheet-moving member 241 to 243 to protrude sheets S through the opening portion 250, and the like. The storage unit control unit 304 controls mechanisms according to the set of storage conditions and the set of discharge conditions received from the controller 302. More specifically, the storage unit control unit 304 controls the conveyance unit 105 to convey a sheet S on which an image has been formed to an appropriate one of the storage portions 201 to 203, and controls the storage device 200 having the sheet-moving member 241 to 243 to move a sheet S stored in each of the storage portions 201 to 203 to the opening portion 250. In addition, an operation display unit controller 306 controls notification of various settings and a discharge instruction provided by a user to the controller 302 using the operation display unit 307. Alternatively, an ID card reader 308 obtains user information from an ID card, and provides a sheet discharge instruction to the controller 302 based on the obtained user information.

(Details of Storage Unit Control Unit)

Figure 5:
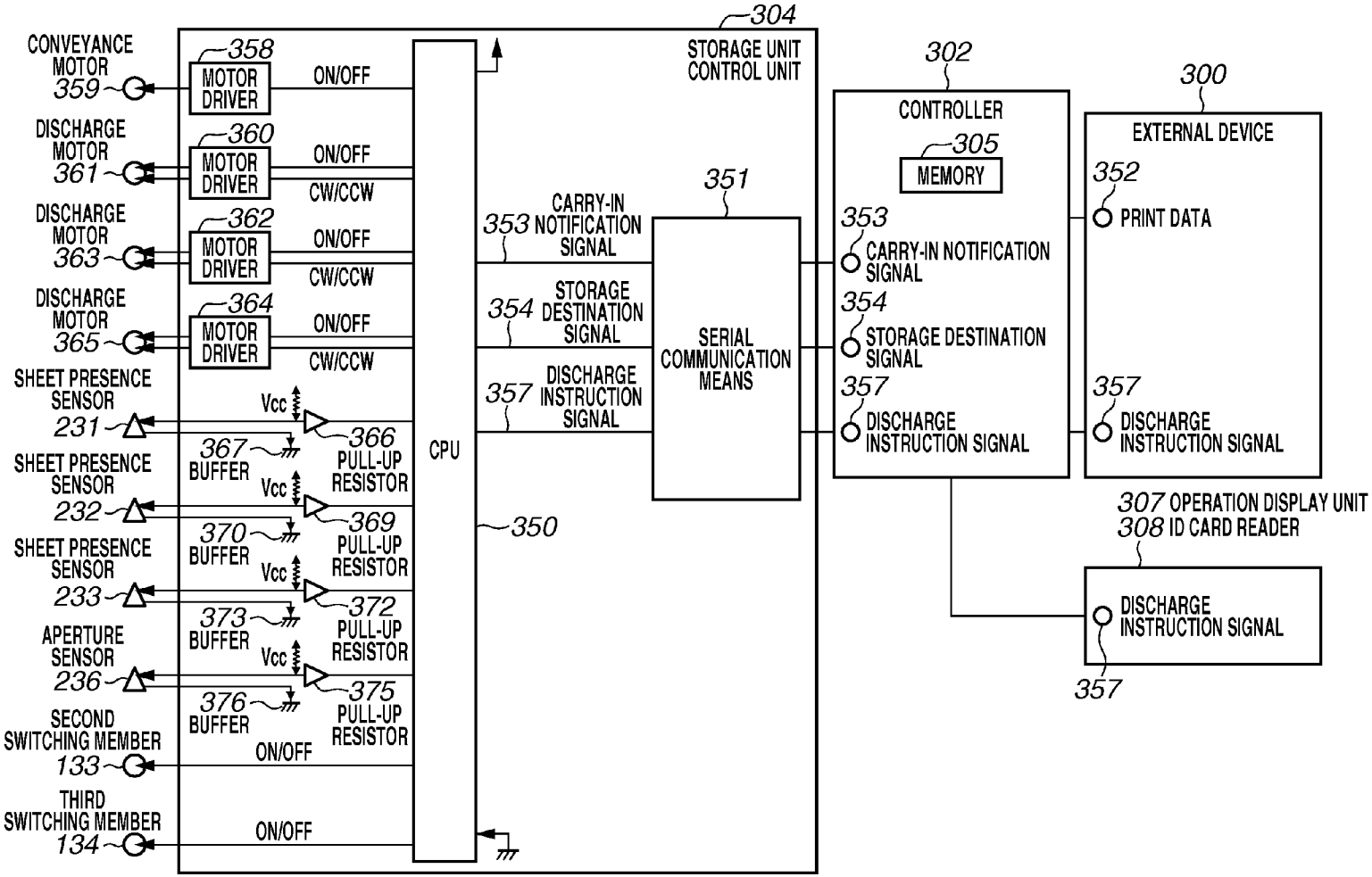
FIG. 5 is a detailed diagram of a storage device control unit according to an exemplary embodiment.

FIG. 5 is a detailed diagram of the storage unit control unit 304 according to the present exemplary embodiment. The storage unit control unit 304 includes a central processing unit (CPU) 350 and a serial communication unit 351. The storage unit control unit 304 communicates with the controller 302 via the serial communication unit 351. The serial communication unit 351 connects the CPU 350 and the controller 302 using a plurality of signal lines.

Control in storing a sheet S in the storage device 200 will be described below. When print data 352 is transferred to the controller 302 from the external device 300, the controller 302 temporarily stores the print data 352 in the memory 305. The controller 302 then analyzes the stored print data 352, and sends a carry-in notification signal 353 and a storage destination signal 354 to the CPU 350 via the serial communication unit 351. The CPU 350 controls the actuators described below based on the sent signals, and causes printed sheets S to be conveyed to the storage portions 201 to 203.

Control in picking up a sheet S from the storage device 200 will be described next. When a user provides an instruction to discharge a sheet S stored in one of the storage portions 201 to 203 using the external device 300, the operation display unit 307, or the ID card reader 308, a discharge instruction signal 357 is sent to the controller 302. The controller 302 determines the target storage portion of the discharge operation, and then sends the discharge instruction signal 357 to the CPU 350 through the serial communication unit 351 to provide an instruction to discharge the sheet S stored in the target storage portion 201, 202, or 203. The CPU 350 controls the actuators described below to protrude the sheet S stored in the notified storage portion out of the image forming apparatus 100 through the opening portion 250.

The actuators connected to the CPU 350 will be described next.

A motor driver 358 is connected to an output terminal of the CPU 350. The motor driver 358 drives a conveyance motor 359. The rotation of the conveyance motor 359 causes the conveyance rollers 211, 212, and 213 to rotate, thereby allowing a sheet S to be conveyed to an appropriate one of the storage portions 201 to 203.

A motor driver 360 is connected to an output terminal of the CPU 350. The motor driver 360 drives a discharge motor 361. The rotation of the discharge motor 361 in a clockwise (CW) direction causes the sheet-moving member 241 of the storage portion 201 to move toward the opening portion 250. The rotation of the discharge motor 361 in a counterclockwise (CCW) direction causes the sheet-moving member 241 of the storage portion 201 to move away from the opening portion 250. Similarly, motor drivers 362 and 364 are connected to output terminals of the CPU 350, and respectively drive discharge motors 363 and 365. The discharge motor 363 controls the sheet-moving member 242 of the storage portion 202. The discharge motor 365 controls the sheet-moving member 243 of the storage portion 203.

The sheet presence sensor 231 uses a pull-up resistor 366, and inputs, to the CPU 350 via a buffer 367, information about whether the storage portion 201 is storing any sheets S. Similarly, the sheet presence sensor 232 inputs information about whether the storage portion 202 is storing any sheets S to the CPU 350, and the sheet presence sensor 233 inputs information about whether the storage portion 203 is storing any sheets S to the CPU 350.

The aperture sensor 236 uses a pull-up resistor 375, and inputs, to the CPU 350 via a buffer 376, information about whether a sheet S is protruding out of the image forming apparatus 100 from the opening portion 250.

An actuator (not illustrated) for switching the second switching member 133 is connected to an output terminal of the CPU 350. The actuator in an ON state causes the second switching member 133 to switch to convey a sheet S to the conveyance guide 129, while the actuator in an OFF state causes the second switching member 133 to switch to convey a sheet S to the conveyance guide 132. Similarly, an actuator (not illustrated) for switching the third switching member 134 is connected to an output terminal of the CPU 350. The actuator in an ON state causes the third switching member 134 to switch to convey a sheet S to the conveyance guide 130, while the actuator in an OFF state causes the third switching member 134 to switch to convey a sheet S to the conveyance guide 131. The CPU 350 switches the switching members 133 and 134 based on the storage destination signal 354 sent from the controller 302.

(Operation of Storage Device)

Figure 6:
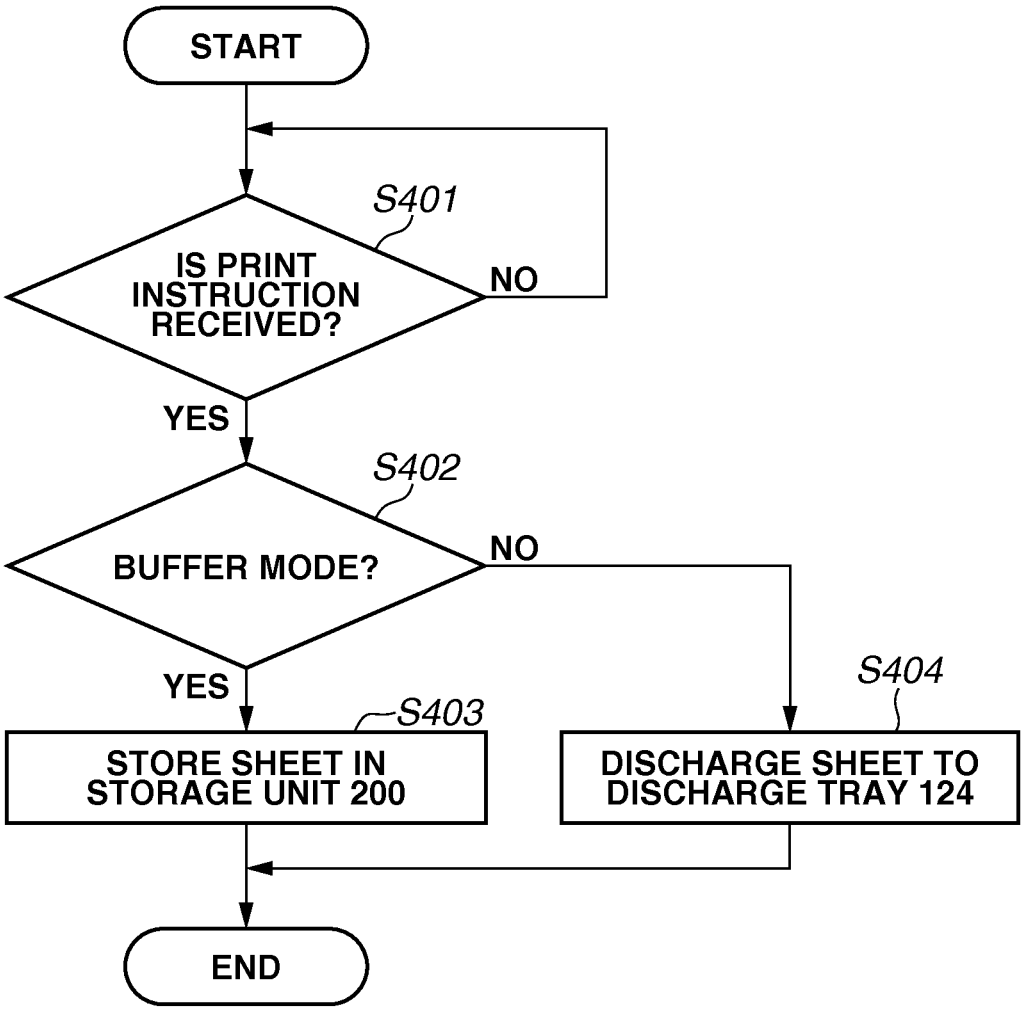
FIG. 6 is a flowchart of a sheet-printing operation according to an exemplary embodiment.

In the image forming apparatus 100 described above, a user can select either a buffer mode or a normal mode by using the external device 300 or the operation display unit 307. In the buffer mode, a sheet S is temporarily stored in the storage device 200. In the normal mode, a sheet S is discharged to the discharge tray 124. The selected mode is stored in the memory 305. FIG. 6 is a flowchart performed when a user provides an instruction to print an image on a sheet S. Control based on this flowchart is performed by the controller 302 and other components described with reference to FIG. 4 according to a program stored in the memory 305.

First, in step S401, when the user provides an instruction to print an image on a sheet S through the external device 300, the print data 352 is sent to the controller 302. Then, when the controller 302 receives the print data 352 (YES in step S401), in step S402, the controller 302 refers to the information stored in the memory 305 to verify that the buffer mode has been selected. If the buffer mode has been selected (YES in step S402), then in step S403, the controller 302 performs control to temporarily store the sheet S in the storage device 200. If the normal mode has been selected (NO in step S402), then in step S404, the controller 302 performs control to discharge the sheet S to the discharge tray 124. The control of this flowchart is then completed. Although the flowchart of FIG. 6 assumes that the user selects a mode in advance, the operation is not limited thereto. For example, the image forming apparatus 100 may be configured in such a manner that the user determines which mode to use in discharging each time the user provides a print instruction.

Figure 7:
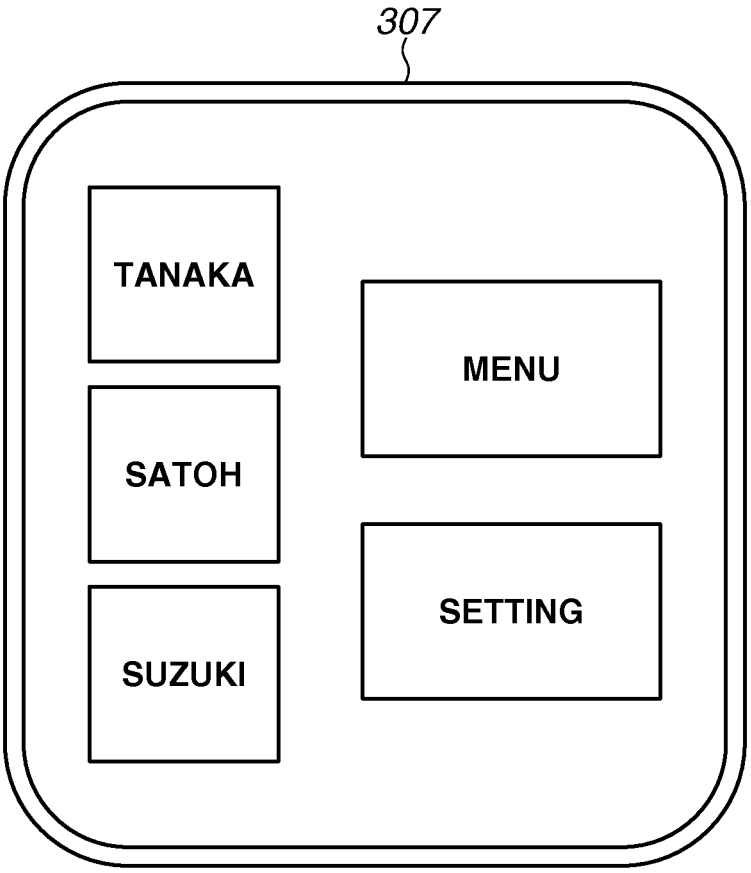
FIG. 7 is an example display of an operation display unit according to an exemplary embodiment.

In the present exemplary embodiment, when sheets S are stored in the storage device 200, the sheets S are distributed to different storage portions for each job number of the sheets S. Moreover, when a sheet S is picked up from the storage device 200, the sheet S of the user that has provided the discharge instruction of the sheet S is protruded out of the image forming apparatus 100 through the opening portion 250. Specific methods for providing a discharge instruction include a user operation on the operation display unit 307 and an ID authentication. In the former method, a screen of the operation display unit 307 displays the name(s) of the user(s) using the storage portion(s) as illustrated in FIG. 7. A touch by a user on an area where the user's name appears causes a discharge instruction signal 357 to be sent to the controller 302. The screen of the operation display unit 307 may display file names, icons that users have registered in advance, and/or other information. In the latter method (i.e., the ID authentication method), bringing the user's own ID card near the ID card reader 308 by the user initiates ID authentication, and a discharge instruction signal 357 is sent to the controller 302 to discharge the sheet S of the job of the user whose ID matches thereof.

In the present exemplary embodiment, as described above, the storage portions 201 to 203 each include an individual actuator for driving the corresponding one of the sheet-moving members 241 to 243. Accordingly, even when more than one storage portion store sheets S of a same user, driving the corresponding actuators allows the user to receive these sheets S at one time. The job number of a sheet S, information about the user who has provided an instruction of printing the sheet S, and other information are stored in the memory 305 provided in the controller 302. In response to a discharge instruction of a user, the controller 302 refers to the memory 305 to determine which sheet S is to be discharged, and instructs the storage device 200 to discharge the sheet S.

Figures 8A, 8B:
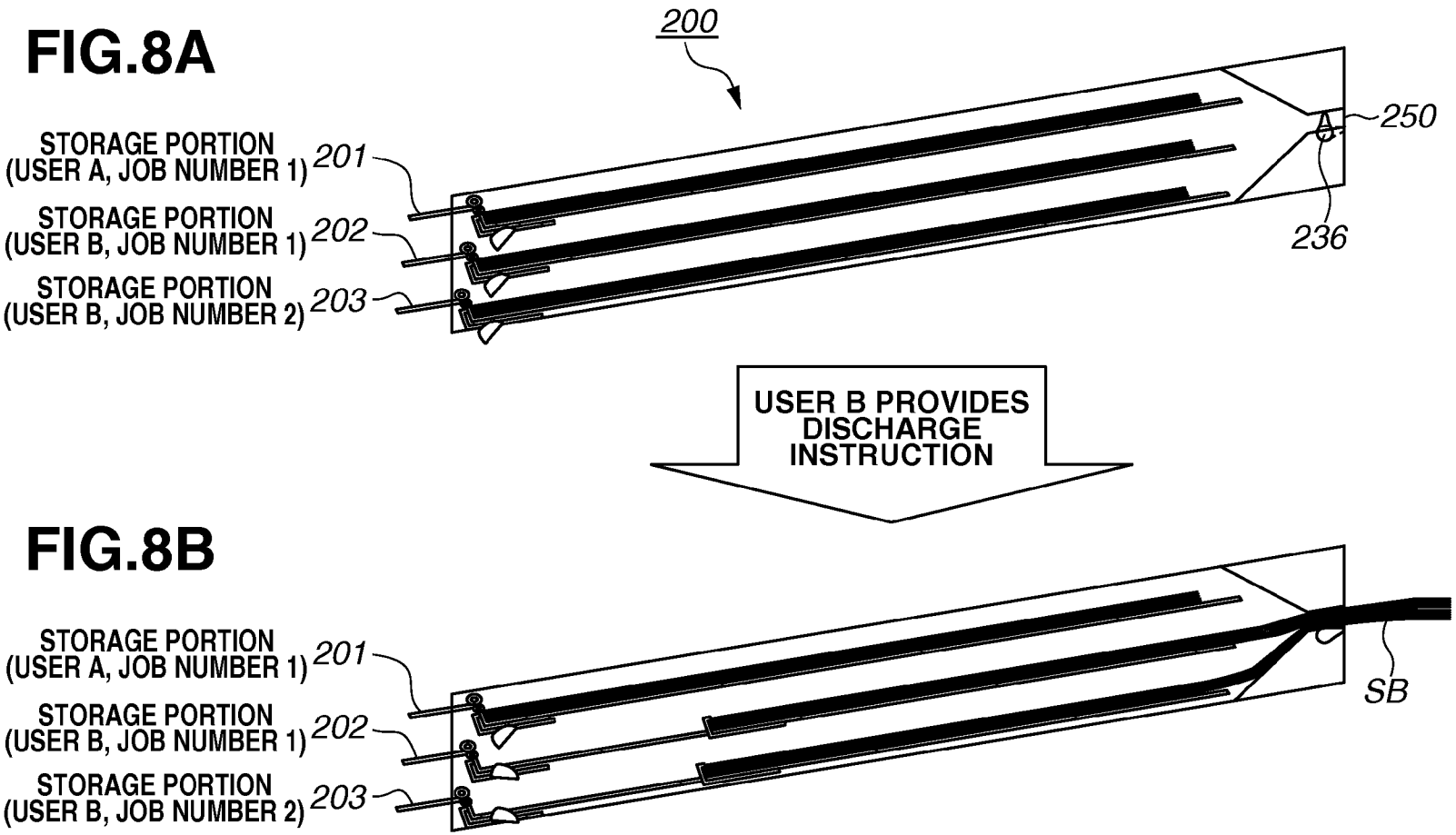
FIGS. 8A and 8B are diagrams illustrating an example of how the storage unit works to protrude sheets according to an exemplary embodiment.

FIGS. 8A and 8B are diagrams illustrating an example operation of the storage device 200. In FIG. 8A, the storage portion 201 stores sheets S of a user A, and the storage portions 202 and 203 each store sheets S of a user B. The storage portion 202 stores the sheets S of job number 1, and the storage portion 203 stores the sheets S of job number 2, of the sheets that the user B has instructed the image forming apparatus 100 to print. In FIG. 8B, when a discharge instruction is provided for the sheets S of the user B, the sheet-moving member 242 and 243 of the storage portions 202 and 203 move toward the opening portion 250, and thus allow a sheet stack SB to protrude through the opening portion 250.

Figure 9:
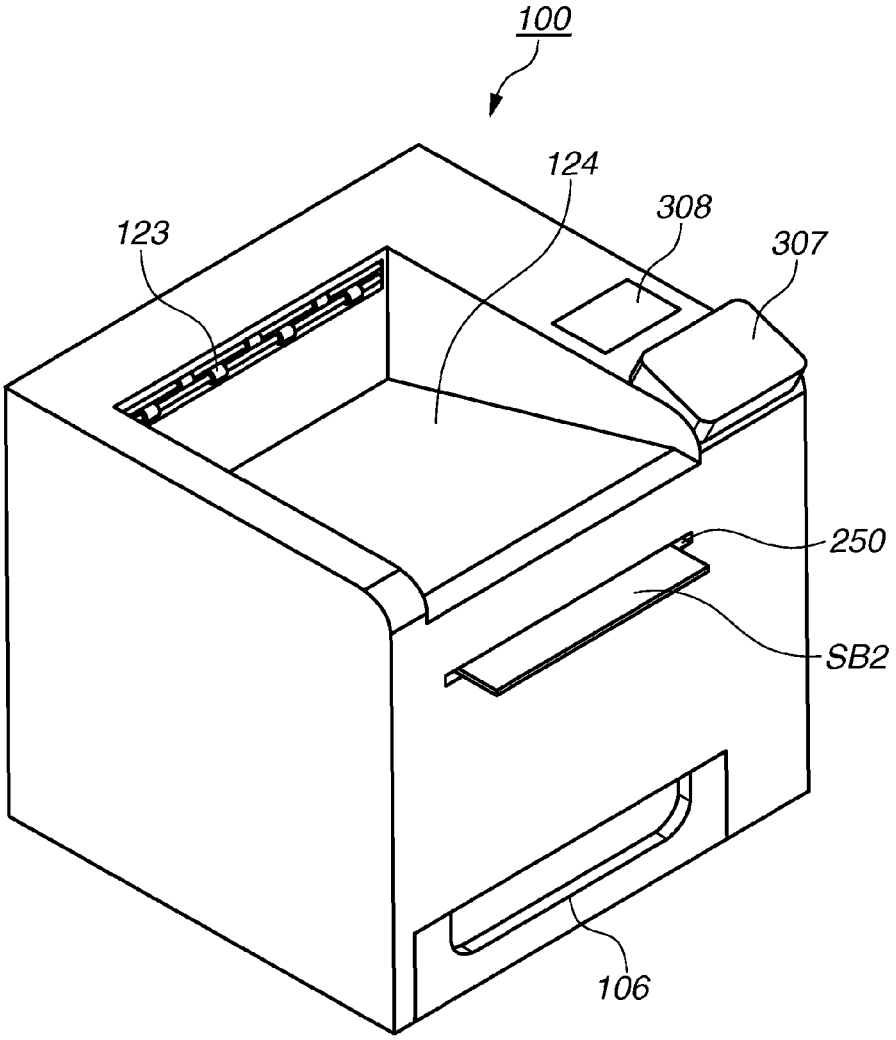
FIG. 9 is a perspective view of the image forming apparatus with some sheets protruding according to an exemplary embodiment.

FIG. 9 is a perspective view of the image forming apparatus 100 at that time. A front edge SB2 of the sheet stack SB that has been protruded from the storage portions 202 and 203 protrudes through the opening portion 250. The user can take out the sheet stack SB by holding and pulling the front edge SB2 that protrudes out of the image forming apparatus 100.

When the user provides an instruction to store more sheets S than a maximum number of sheets that one storage portion can store, the sheets S are distributed to different storage portions even when a same job number is assigned to those sheets S. For example, FIG. 8A illustrates the storage portions 202 and 203 storing sheets S of the user B respectively having different job numbers. However, if the number of sheets of job number 1 is larger than a maximum number of sheets that the storage portion 202 can store, then a part of the sheets S of job number 1 will be stored also in the storage portion 203, provided that the storage portion 203 is not storing other sheets S. As used herein, other sheets include a sheet having a different job number and a sheet of another user.

The storage device 200 is enclosed except for an inlet (not illustrated) to carry in a sheet S, and the opening portion 250 to protrude a stored sheet S. In addition, the members surrounding the storage device 200 are each made of an opaque material. Thus, information printed on a sheet S in each of the storage portions 201 to 203 is hidden from a user during storage in the storage portions 201 to 203. This prevents information printed on a user's own sheet S from being seen by other user, thereby achieving a higher level of confidentiality of information.

Meanwhile, in a sense of achieving a higher level of confidentiality of information, some image forming apparatuses perform user authentication using an ID card or other technology, and thereafter start image formation. As compared with such apparatuses, the image forming apparatus 100 according to the present exemplary embodiment only needs to protrude a sheet S on which an image has been formed, from the corresponding one of the storage portions 201 to 203. Thus, a user can promptly pick up the sheet S after user authentication is completed without need for waiting for an image to be formed.

Moreover, a discharge instruction by a user to the image forming apparatus 100 enables the user to pick up only the user's own sheets. This eliminates the need for a user to find out the user's own sheets in the discharge tray 124 that stores both the user's own sheets and sheets of another user.

(Detailed Description of Buffer Mode)

Next, control in a buffer mode will be described in detail using the flowchart of FIG. 10. The control based on this flowchart is performed by the controller 302 and other components described with reference to FIG. 4 according to a program stored in the memory 305.

First, when the buffer mode has been selected, and when the controller 302 receives a print instruction from a user (YES in step S500), in step S501, the controller 302 determines whether the sheet to be printed can be stored in the storage device 200. More specifically, in step S501, the controller 302 determines whether the number of sheets to be printed is less than or equal to a maximum number of sheets that can be stored in the storage device 200 upon reception of the print instruction. The user who has provided the print instruction in step S500 of FIG. 10 is hereinafter referred to as user A. As used herein, a maximum number of sheets that can be stored in the storage device 200 in step S501 is the number of sheets that can be stored in storage portions that are not storing any sheets (vacant storage portions). In the present exemplary embodiment, one storage portion can store up to ten sheets. If there is no vacant storage portion, then the maximum number of sheets that can be stored in the storage device 200 is zero. If there is only one vacant storage portion, then the maximum number of sheets that can be stored in the storage device 200 is 10. If the controller 302 determines that the number of sheets to be printed (the number of sheets of that job) is less than or equal to the maximum number of sheets that can be stored (YES in step S501), then in step S502, the controller 302 performs control so that the sheets are conveyed to a vacant storage portion. In step S503, upon completion of sheet conveyance to a storage portion, the controller 302 may display a message on a screen of the external device 300 of the user A informing that the sheet storage is completed. If the user goes to pick up the sheets after confirming the completion of sheet storage as described above, there is no need for the user to wait in front of the apparatus until the sheet storage is completed. Thereafter, when the controller 302 receives a discharge instruction from the user A (YES in step S504), the controller 302 controls the sheet-moving member 241, 242, or 243 of the corresponding one of the storage portions 221 to 223 to protrude the sheet of the user A through the opening portion 250 in step S505. In step S506, before the sheet-moving member 241, 242, or 243 is moved, the controller 302 may display a message on a screen of the operation display unit 307 informing that the sheet will protrude through the opening portion 250. Then, the user A can take out the user A's own sheet protruding through the opening portion 250. The controller 302 detects pickup of the sheet of the user A protruding through the opening portion 250 by a transition from an ON state to an OFF state of the aperture sensor 236 (YES in step S507). The controller 302 moves the sheet-moving member 241, 242, or 243 that was moved to the protruding position to protrude the sheet of the user A, back to the stacking position, and thus the corresponding storage portion is made ready for storing next sheet.

On the other hand, in step S501, if the controller 302 determines that the number of sheets to be printed is larger than the maximum number of sheets that can be stored (NO in step S501), then the controller 302 transitions to a standby state. The standby state is a state in which the controller 302 waits for a discharge instruction from a user B, who is different from the user A (step S508), or for a discharge instruction from the user A (step S513). The user B is a user who has been using the storage device 200 since before the user A has provided the print instruction. In other words, when the user A provides the print instruction in step S500, at least one of the storage portions 221 to 223 stores a sheet of the user B. The sheet of the user A is not printed in this standby state. When the controller 302 receives a discharge instruction from the user B (YES in step S508), the controller 302 controls the sheet-moving member 241, 242, or 243 of the corresponding one of the storage portions 221 to 223 to protrude the sheet of the user B through the opening portion 250 in step S509. In step S510, before the sheet-moving member 241, 242, or 243 is moved, the controller 302 may display a message on a screen of the operation display unit 307 informing that the sheet will protrude through the opening portion 250. When the controller 302 detects pickup of the sheet using the aperture sensor 236 (YES in step S511), the controller 302 determines in step S512 that there is available storage space in the storage device 200, and then in step S502, printing of the sheet of the user A is started. The flow thereafter is the same as described above (steps S502 to S507).

If the user A attempts to pick up the sheet in a standby state while there is no available storage space in the storage device 200, the process proceeds as follows. When the controller 302 receives a discharge instruction from the user A (YES in step S513), printing of the sheet of the user A is started in step S514. At this time, the discharge destination of the sheet is switched from the storage device 200 to the discharge tray 124. The printed sheets of the user A are sequentially discharged to the discharge tray 124. In step S515, before the sheet is discharged to the discharge tray 124, the controller 302 may display a message on a screen of the operation display unit 307 informing that the sheet will be discharged to the discharge tray 124.

As described above, depending on the availability of the storage device 200, the pickup position of the sheet is changed between the two positions, i.e., the opening portion 250 and the discharge tray 124. Therefore, displaying the discharge destination of the sheet on the operation display unit 307 in steps S506 and S515 helps the user to pick up the user's own sheet with certainty. Alternatively, the user may be informed of the discharge destination by providing light emitting diode (LED) lamps (not illustrated) respectively near the opening portion 250 and the discharge tray 124, and by turning on or flashing the LED lamp near the one used for discharge. The user does not necessarily need to be informed of the discharge destination. This is because the sheet is discharged according to a discharge instruction by the user, and the user only needs to pick up the discharged sheet. Thus, control may be provided in such a manner that when the user provides a discharge instruction from the external device 300 (i.e., the user is not in front of the apparatus), the user is informed of the discharge destination by, for example, turning on or flashing an appropriate LED lamp for a predetermined time period. On the other hand, when the user provides a discharge instruction from the operation display unit 307 or from the ID card reader 308 (i.e., the user is in front of the apparatus), the user is not informed of the discharge destination.

Providing the control described above achieves advantages as follows. Even when a print instruction is provided while there is no available storage portion, the sheet is stored in one of the storage portions 221 to 223 once storage space becomes available, which maximizes a benefit of the storage device 200 that the user can pick up the user's own sheets at one time. Otherwise, even if there is no available storage portion until the user provides a discharge instruction, the discharge instruction by the user causes printing to be started, and then the sheet to be discharged to the discharge tray 124. Therefore, the user can pick up the user's own sheets at one time. In other words, even when there is no available storage portion, there is no case where the user cannot pick up the user's own sheet. Moreover, even when the sheet is discharged to the discharge tray 124, the user's own sheet can be easily identified, which eliminates the need for the user to find out the user's own sheet in the discharge tray 124 that stores both the user's own sheet and a sheet of another user.

Figure 10:
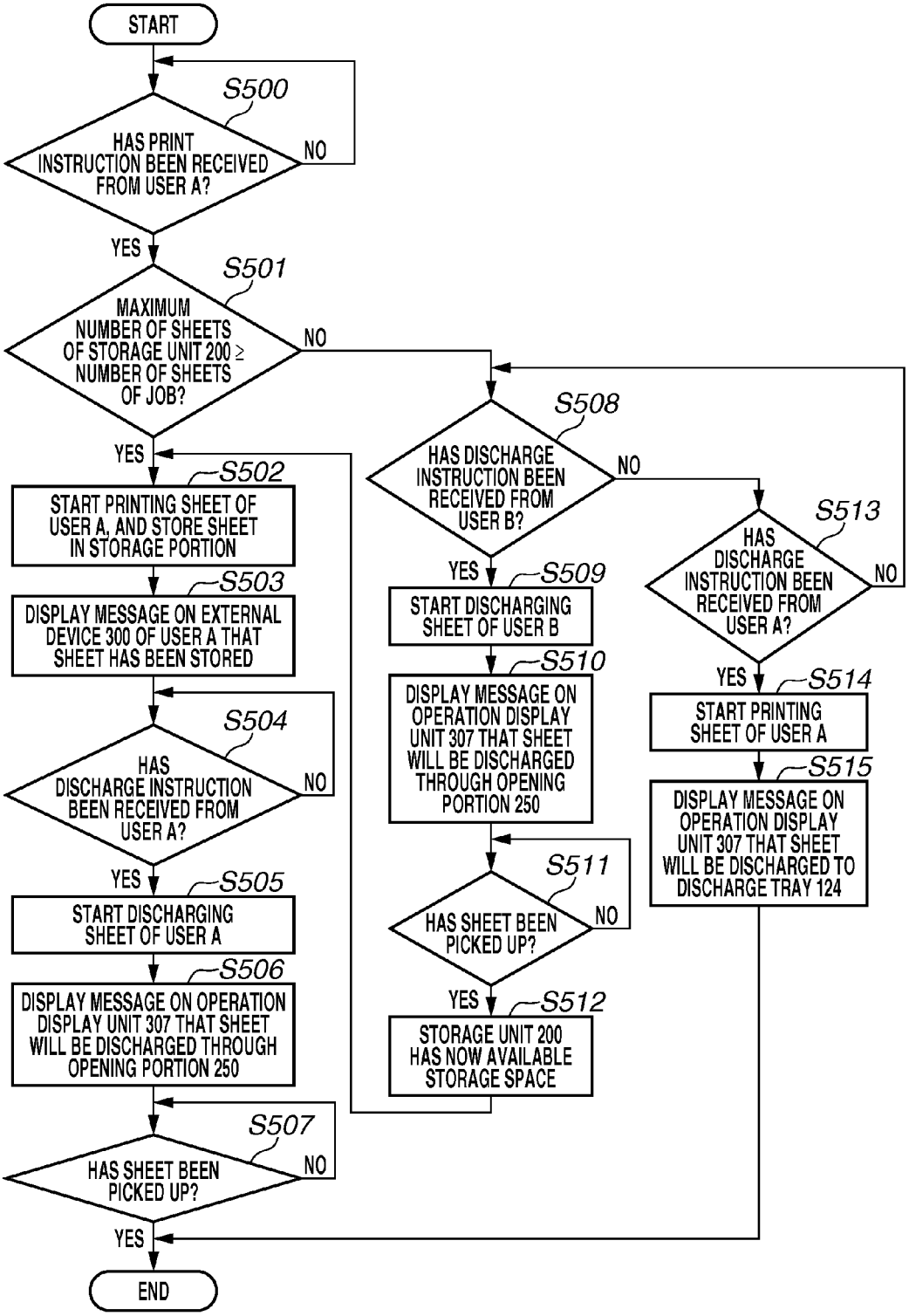
FIG. 10 is a flowchart illustrating an operation according to a first exemplary embodiment.

Although the flowchart of FIG. 10 illustrates that the printing operation of the sheet of the user A is suspended in a standby state, the printing operation may be continued to a certain extent. For example, the printing operation may be continued until the front edge of the sheet reaches the first switching member 120, and then the sheet may be retained on a conveyance path until a next instruction is received. This is feasible because the printed sheet can be conveyed to either the storage device 200 or the discharge tray 124 by switching the discharge destination depending on the instruction if the front edge of the sheet has not yet passed the first switching member 120. If printing is performed on both sides of the sheet, printing on the front surface may be continued, and then the sheet having the front surface on which an image has been formed may be retained on the double-sided conveyance path 126 until a next instruction is received. This operation reduces the time until the user A receives the sheet.

In addition, the flowchart of FIG. 10 illustrates that the image forming apparatus 100 starts printing of the sheet of the user A in step S502 after detecting the available storage space in the storage device 200 in step S512. However, the image forming apparatus 100 may start printing the sheet of the user A upon reception of the discharge instruction from the user B in step S508. This operation reduces the time until the user A receives the sheet.

Furthermore, the flowchart of FIG. 10 assumes that the storage device 200 has stored one or more sheets of the user B before the user A provides the print instruction. However, the storage device 200 does not necessarily need to be storing any sheets when the user A provides the print instruction. In such a case, the discharge instruction of the user A should only be received in a standby state, and the control of steps S509 to S512 will not be performed.

In addition, in the present exemplary embodiment, when sheets S are stored in the storage device 200, the sheets S are distributed to different storage portions for different job numbers of the sheets S. Therefore, a maximum number of sheets of the storage device 200 in step S501 of the flowchart of FIG. 10 has been defined as the number of sheets that can be stored in the vacant storage portion. However, the definition is not limited thereto.

For example, the sheets S may be distributed to different storage portions for each of the users who have provided the print instructions of the sheets S. In other words, sheets S on which the same user has provided the print instructions are stored in a same storage portion even if these sheets S have different job numbers. In this case, a maximum number of sheets of the storage device 200 in step S501 of the flowchart of FIG. 10 includes a maximum number of sheets that can be additionally stored in the storage portion that is storing sheets S of the same user. Thus, in step S501, if there is no vacant storage portion, and one storage portion is storing sheets S of the same user, then the number of sheets S to be printed is compared with the maximum number of sheets that can be additionally stored in that storage portion. If the controller 302 determines that the number of sheets to be printed is less than or equal to the maximum number of sheets that can be additionally stored, then the controller 302 performs control so that the sheets are conveyed to that storage portion. On the other hand, if the controller 302 determines that the number of sheets to be printed is greater than the maximum number of sheets that can be additionally stored, then the controller 302 transitions to the standby state.

Next, a second exemplary embodiment will be described. The only differences from the first exemplary embodiment will be described below. The same reference characters are given to the same or similar components, and the explanation thereof will be omitted.

Figure 11:
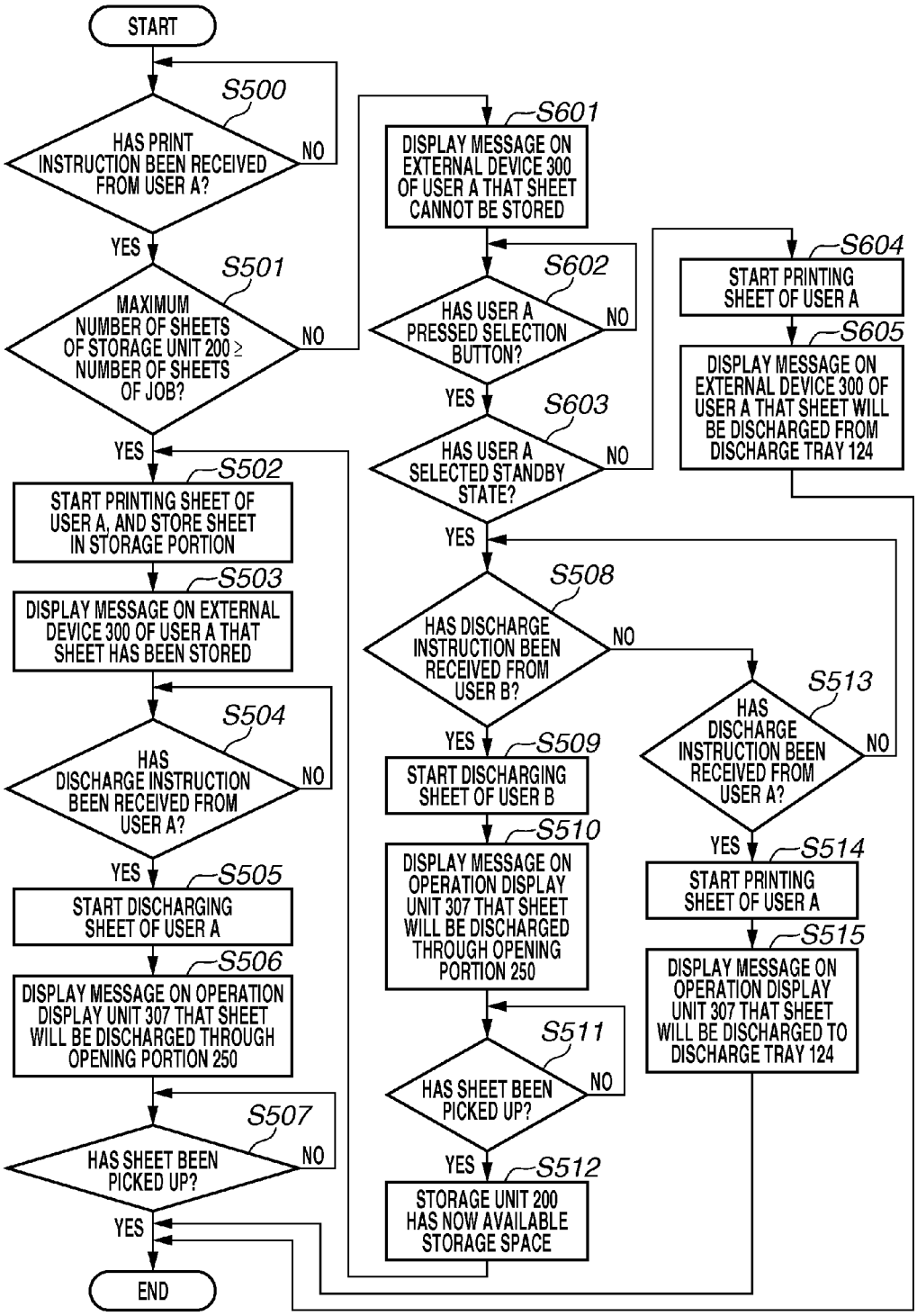
FIG. 11 is a flowchart illustrating an operation according to a second exemplary embodiment.

Control of the present exemplary embodiment will be described below in detail referring to the flowchart of FIG. 11. The control based on this flowchart is performed by the controller 302 and other components described with reference to FIG. 4 according to a program stored in the memory 305.

First, when the buffer mode has been selected, and when the controller 302 receives a print instruction from a user (YES in step S500), the controller 302 determines whether the sheet to be printed can be stored in the storage device 200. More specifically, in step S501, the controller 302 determines whether the number of sheets to be printed is less than or equal to a maximum number of sheets that can be stored in the storage device 200 upon reception of the print instruction. The user who has provided the print instruction in step S500 of FIG. 11 is hereinafter referred to as "user A". If the controller 302 determines that the number of sheets to be printed is less than or equal to the maximum number of sheets that can be stored (YES in step S501), then the processes that will be performed are similar to those illustrated in steps S502 to S507 of the first exemplary embodiment, and thus the description thereof will be omitted.

Figure 12:
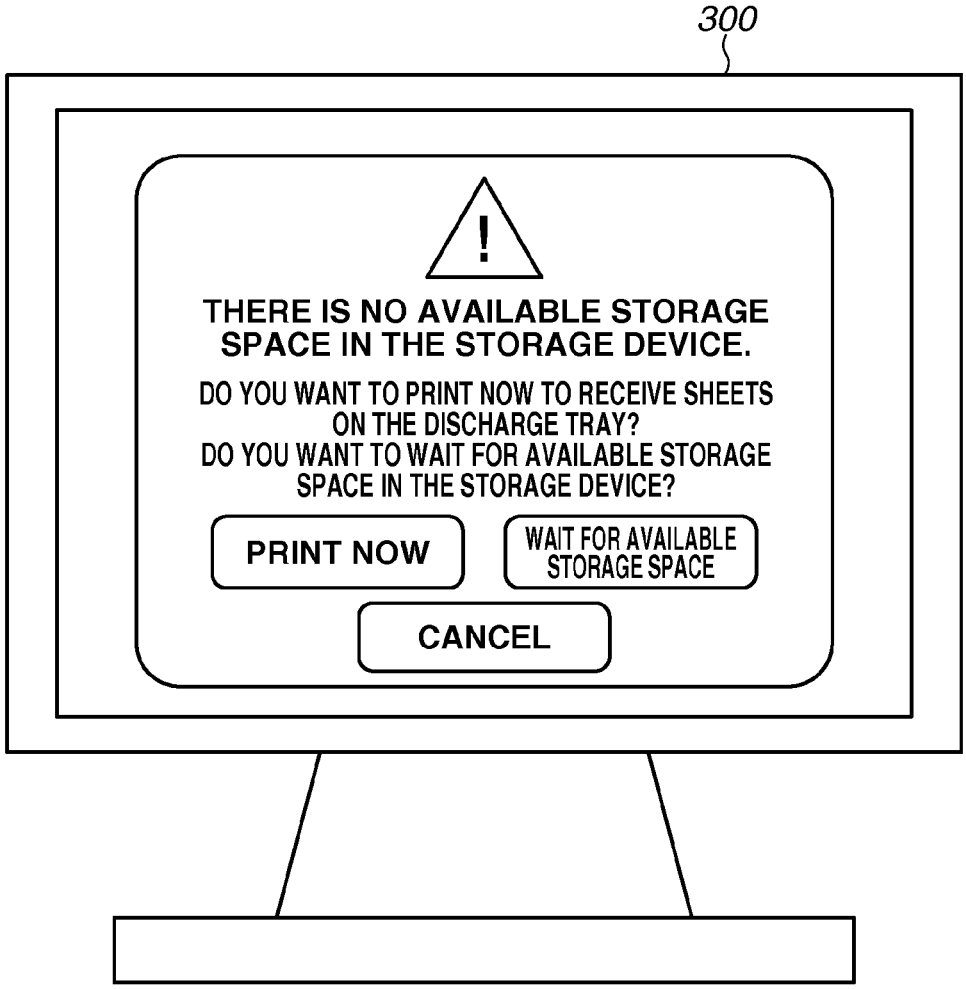
FIG. 12 is an example display on an external device according to the second exemplary embodiment.

On the other hand, in step S501, if the controller 302 determines that the number of sheets to be printed is larger than the maximum number of sheets that can be stored (NO in step S501), then in step S601, the controller 302 displays a message on a screen of the external device 300 of the user A informing that the storage device 200 has no available storage space. FIG. 12 illustrates an example screen thereof. The screen of FIG. 12 allows the user A to select printing now and discharging the sheet to the discharge tray 124, or waiting for the storage device 200 to be available (i.e., to cause a transition to the standby state of the first exemplary embodiment). The user A selects one of the options on this screen (YES in step S602). If the user A select a transition to the standby state (YES in step S603), then the processes that will be performed are similar to those illustrated in steps S508 to S515 of the first exemplary embodiment, and thus the description thereof will be omitted. In the present exemplary embodiment, the discharge instruction from the user A received by the controller 302 in step S513 is interpreted as an instruction to terminate the standby state, and the process is performed accordingly.

In step S603, if the user A select printing now and discharging the sheet to the discharge tray 124 (NO in step S603), then in step S604, the controller 302 performs control to start printing of the sheet of the user A. At this time, the discharge destination of the sheet is switched from the storage device 200 to the discharge tray 124. The printed sheets of the user A are sequentially discharged to the discharge tray 124. In step S605, before the sheet is discharged to the discharge tray 124, the controller 302 may display a message on a screen of the external device 300 of the user A informing that the sheet will be discharged to the discharge tray 124. The user A is expected to wait for completion of sheet discharge for an estimated time, and then to go to the image forming apparatus 100 to pick up the user A's own sheet. If "Cancel" is selected on the screen of FIG. 12, the screen returns to a print setting screen.

As described above, the flow according to the present exemplary embodiment provides an advantage in that the user can select how the sheet will be discharged depending on the user's current situation. For example, the user may select "Print Now" when printing an urgent job having a small number of sheets. On the other hand, when printing a non-urgent job, the user may choose "Wait for the space becoming available". In this case, waiting for a certain time period may allow the user to pick up the user's own sheets from a storage portion at one time.

Also, in the present exemplary embodiment, the image forming apparatus 100 may be configured in such a manner that an initial setting can be set from the external device 300 and/or the operation display unit 307 with respect to which process to be normally performed when the storage device 200 has no available storage space, instead of requesting the user to select the subsequent process each time.

Next, a third exemplary embodiment will be described. In the description, only differences from the first exemplary embodiment will be described below. The same reference characters are added to the same or similar components, and the description thereof will be omitted.

Figure 13:
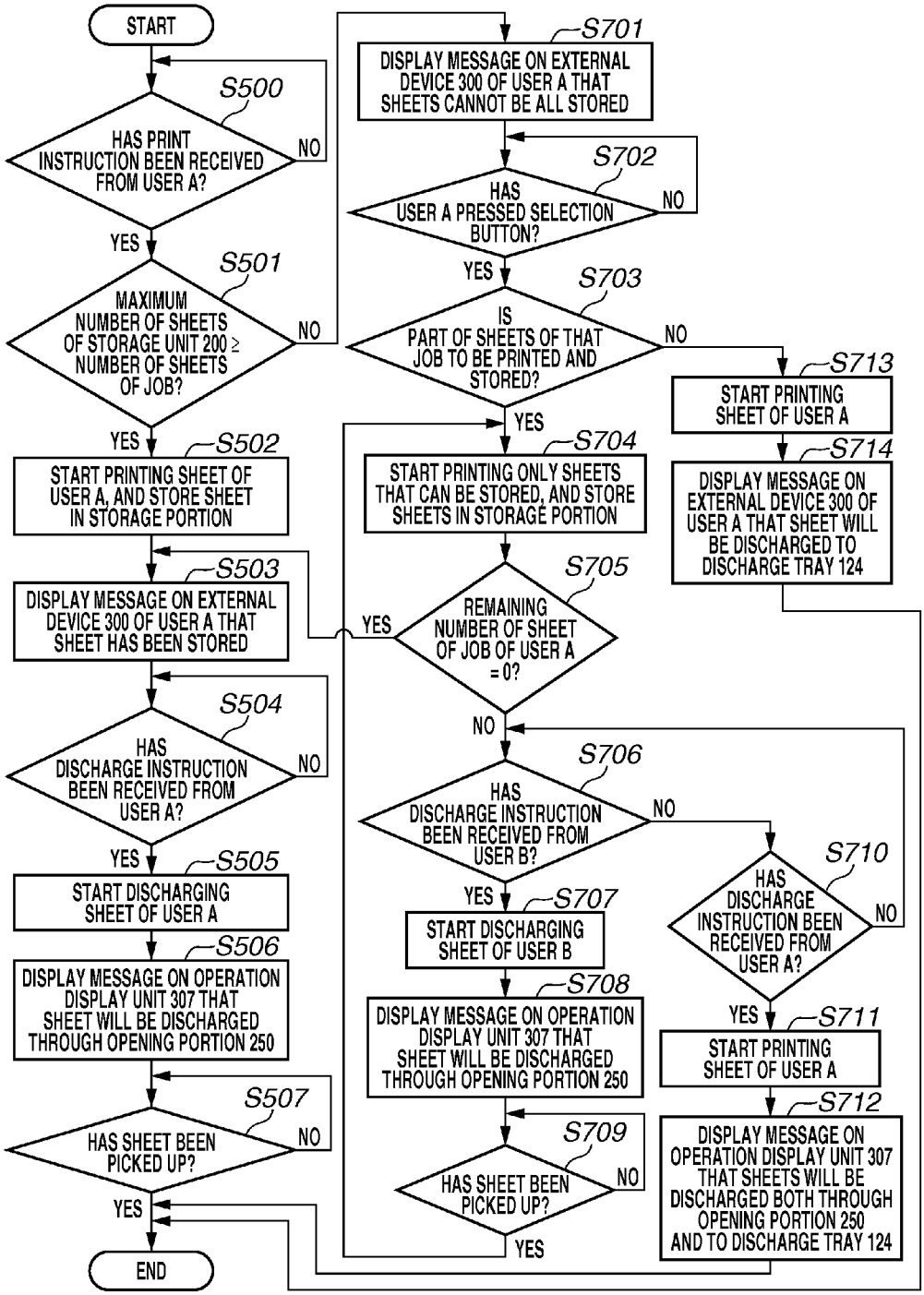
FIG. 13 is a flowchart illustrating an operation according to a third exemplary embodiment.

Control of the present exemplary embodiment will be described below in detail referring to the flowchart of FIG. 13. The control based on this flowchart is performed by the controller 302 and other components described with reference to FIG. 4 according to a program stored in the memory 305. In addition, the flowchart of FIG. 13 assumes that when the controller 302 receives the print instruction from the user A in step S500, at least one of the storage portions 221 to 223 is vacant.

First, when the buffer mode has been selected, and when the controller 302 receives a print instruction from a user (YES in step S500), the controller 302 determines whether the sheets to be printed can be stored in the storage device 200. More specifically, in step S501, the controller 302 determines whether the number of sheets to be printed is less than or equal to a maximum number of sheets that can be stored in the storage device 200 upon reception of the print instruction. The user who has provided the print instruction in step S500 of FIG. 13 is hereinafter referred to as "user A". If the controller 302 determines that the number of sheets to be printed is less than or equal to the maximum number of sheets that can be stored (YES in step S501), then the processes that will be performed are similar to those illustrated in steps S502 to S507 of the first exemplary embodiment, and thus the description thereof will be omitted.

Figure 14:
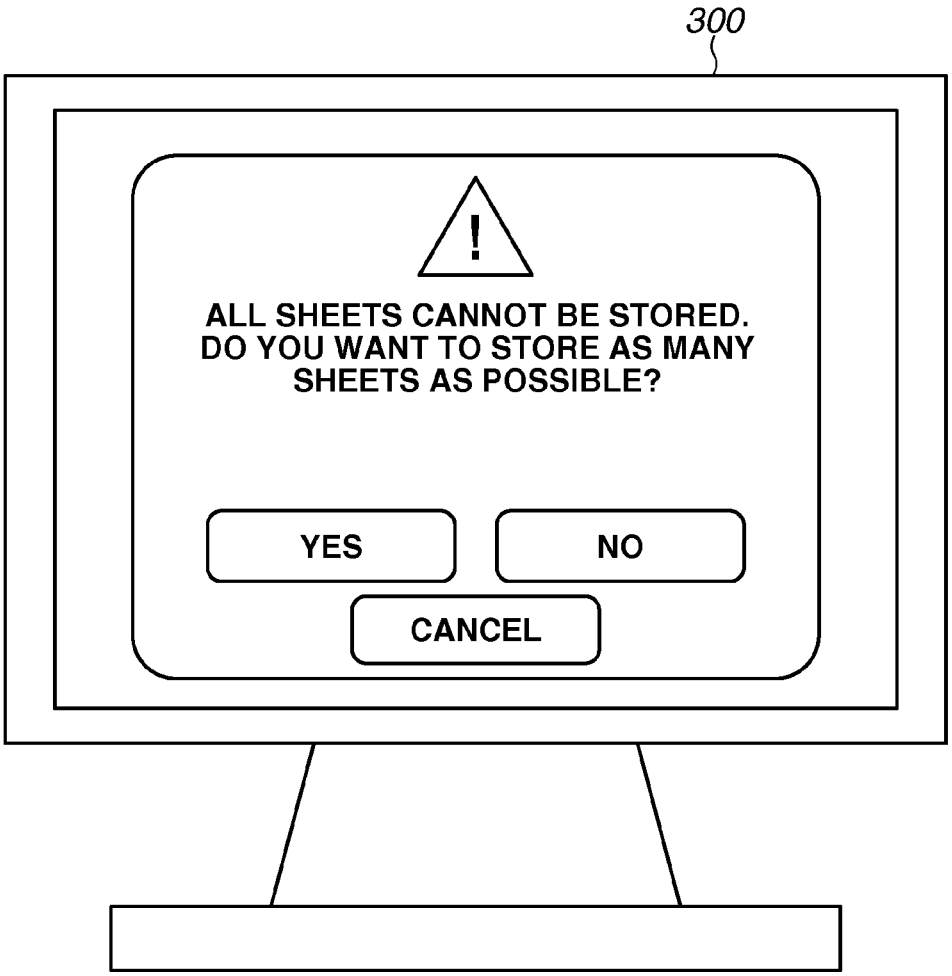
FIG. 14 is an example display on the external device according to the third exemplary embodiment.

On the other hand, in step S501, if the controller 302 determines that the number of sheets to be printed is larger than the maximum number of sheets that can be stored (NO in step S501), then in step S701, the controller 302 displays a message on a screen of the external device 300 of the user A informing that the all sheets cannot be stored. FIG. 14 illustrates an example screen thereof. The screen of FIG. 14 allows the user A to select whether to print a part of the sheets of that job, and to store these sheets in a storage portion. The user A selects one of the options on this screen (YES in step S702). If the user A selects printing a part of the sheets of that job, and storing these sheets in a storage portion (YES in step S703), then in step S704, the controller 302 performs control to start printing as many sheets as the storage device 200 can store, and to convey the printed sheets to a vacant storage portion. Then, the controller 302 checks the number of sheets yet to be printed of the job of the user A, and if the remaining number of sheets is zero (YES in step S705), then the processing proceeds to step S503. On the other hand, if there are any sheets yet to be printed of the job of the user A (NO in step S705), the controller 302 transitions to a standby state. As used herein, a standby state is a state in which the controller 302 waits for a discharge instruction from a user B, who is different from the user A (step S706), or for a discharge instruction from the user A (step S710). The user B is a user who has been using the storage device 200 since before the user A provided the print instruction. In other words, when the user A provides the print instruction in step S500, at least one of the storage portions 221 to 223 stores the sheet of the user B. The remaining sheets of the job of the user A are not printed in this standby state. When the controller 302 receives a discharge instruction from the user B (YES in step S706), the controller 302 controls the sheet-moving member 241, 242, or 243 of the corresponding one of the storage portions 221 to 223 to protrude the sheet of the user B through the opening portion 250 in step S707. In step S708, before the sheet-moving member 241, 242, or 243 is moved, the controller 302 may display a message on a screen of the operation display unit 307 informing that the sheet will protrude through the opening portion 250. When the controller 302 detects pickup of the sheet by using the aperture sensor 236 (YES in step S709), in step S704, the controller 302 performs control to start printing as many sheets as the storage device 200 can additionally store of the job of the user A, and to convey the sheet to a vacant storage portion.

The procedure performed in a case where the user A attempts to pick up the sheet in a standby state while there is no available storage space in the storage device 200 is as follows. When the controller 302 receives a discharge instruction from the user A (YES in step S710), printing of the remaining sheets is started if there are any sheets of the user A yet to be printed in step S711. In step S712, printed sheets of the user A are sequentially discharged to the discharge tray 124. In parallel with this operation, the controller 302 performs control so that the sheet of the user A stored in the corresponding storage portion partially protrudes through the opening portion 250. This operation allows the user A to pick up the user A's own sheets from two locations, i.e., the opening portion 250 and the discharge tray 124. Also in step S712, the controller 302 may display a message on a screen of the operation display unit 307 informing that the sheets will be discharged through the opening portion 250 and the discharge tray 124 before the sheets are discharged through the opening portion 250 or the discharge tray 124. In the present exemplary embodiment, the discharge instruction from the user A received by the controller 302 in step S710 is interpreted as an instruction to terminate the standby state, and the process is performed accordingly.

On the other hand, in step S703, if the user A does not select printing a part of the sheets of that job to store in a storage portion (NO in step S703), then in step S713, the controller 302 performs control to start printing of the sheet of the user A. At this time, the discharge destination of the sheet is switched from the storage device 200 to the discharge tray 124. The printed sheets of the user A are sequentially discharged to the discharge tray 124. In step S714, before the sheet is discharged to the discharge tray 124, the controller 302 may display a message on a screen of the external device 300 of the user A informing that the sheet will be discharged to the discharge tray 124.

As described above, even when the user provides an instruction to print more sheets than the storage device 200 can store, storing a part of these sheets in a storage portion can reduce the number of sheets to be printed after the user provides a discharge instruction. Therefore, a time can be reduced, which is required for the user to wait for completion of printing of the user's own job in front of the image forming apparatus 100.

Next, a fourth exemplary embodiment will be described. The present exemplary embodiment describes an image forming system that includes a plurality of image forming apparatuses 100, each having the storage device 200, connected to one another in a networking environment. In other words, the image forming system of the present exemplary embodiment includes a plurality of the image forming apparatuses 100. The image forming apparatus 100 to be used can be arbitrarily selected from the external device 300. One of the plurality of image forming apparatuses 100 is pre-registered as the image forming apparatus that is normally used when a print instruction is provided from the external device 300. It is assumed here that there are four selectable image forming apparatuses, which are respectively referred to as image forming apparatuses A, B, C, and D, and that the normally-used image forming apparatus is the image forming apparatus D. In the present exemplary embodiment, the only differences from the first exemplary embodiment will be described below. The same reference characters are given to the same or similar components, and the description thereof will be omitted.

Figures 15, 15A:
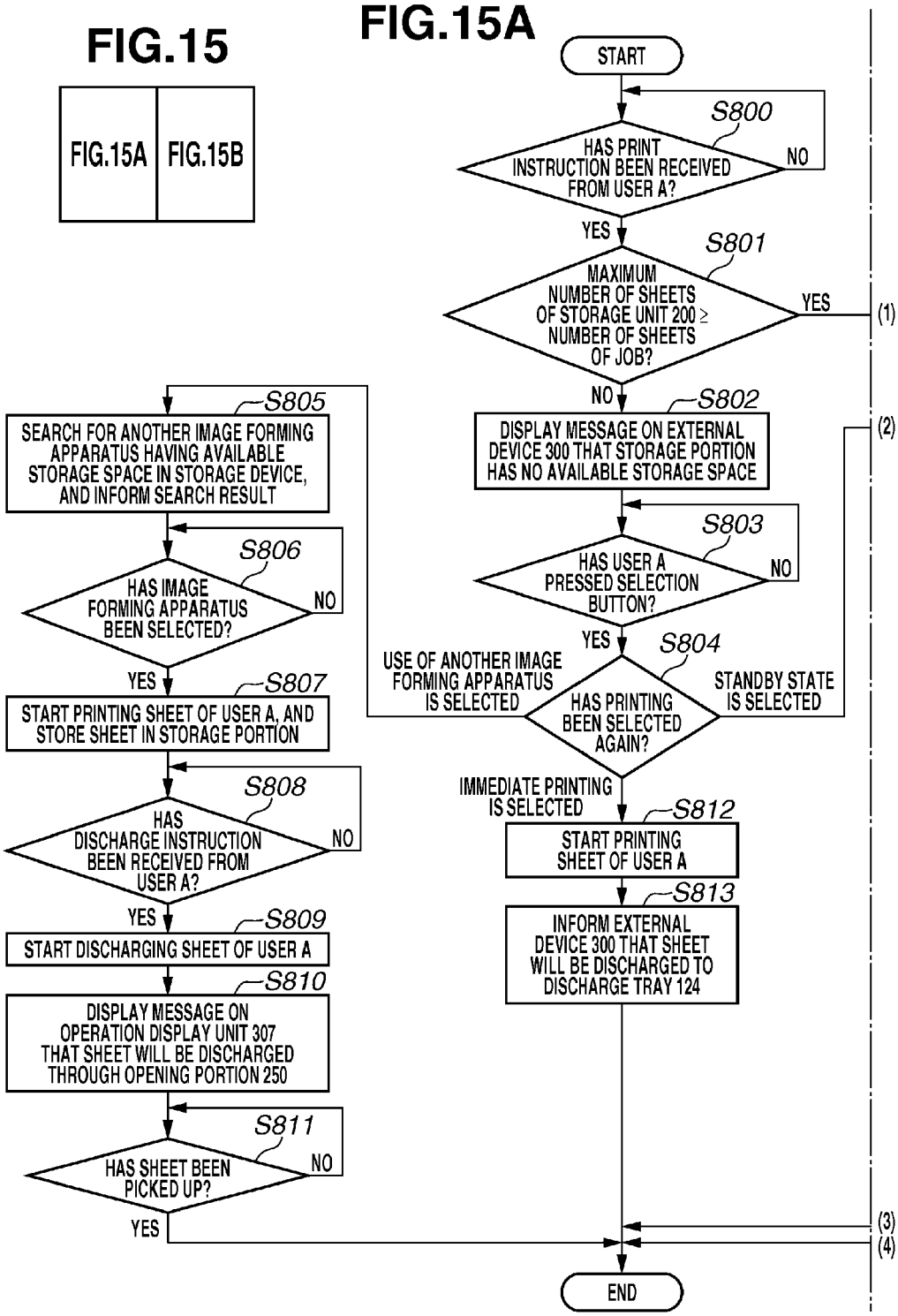
FIG. 15 (consisting of FIGS. 15A and 15B) is a flowchart illustrating an operation according to a fourth exemplary embodiment.
Figure 15B:
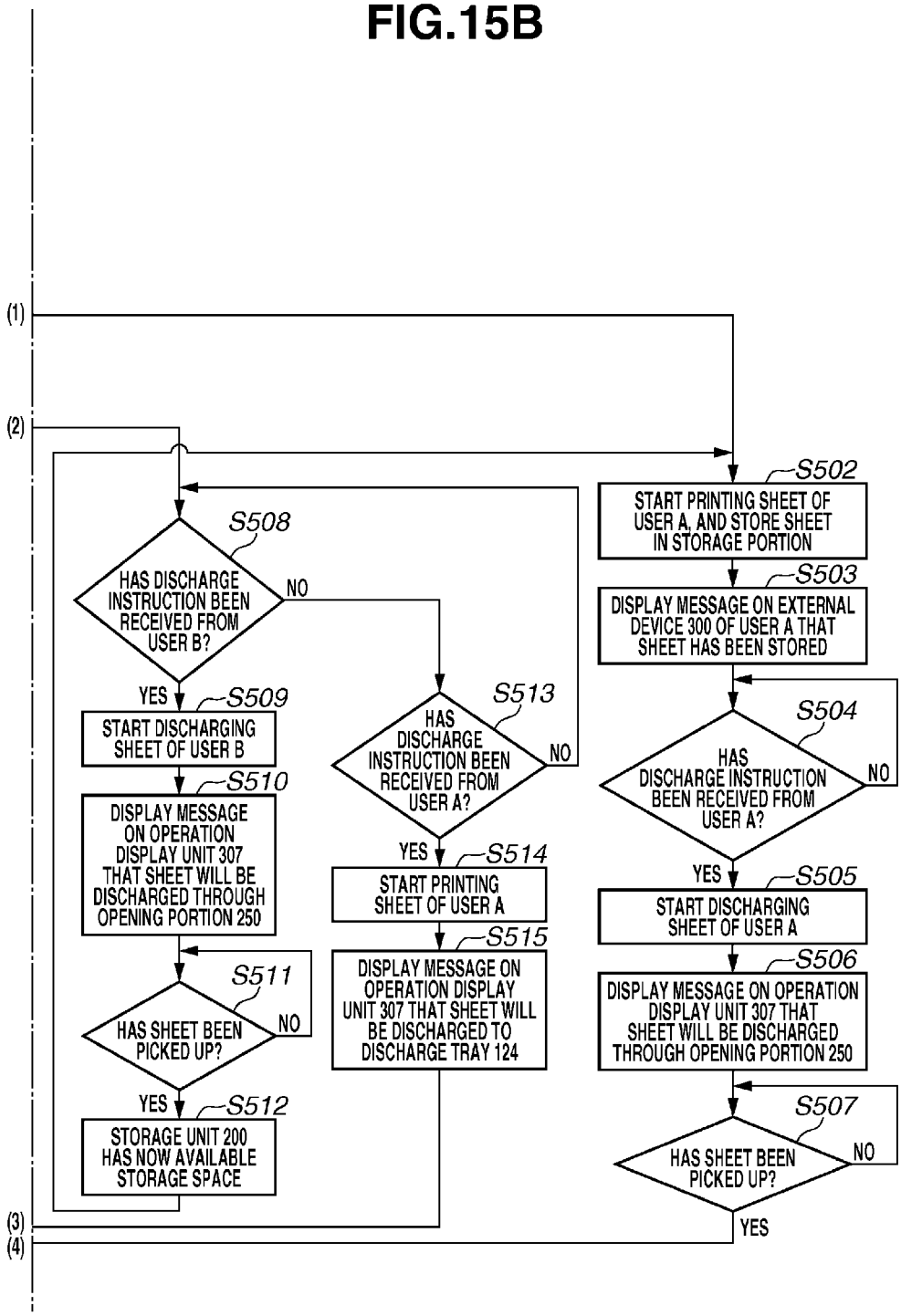

Control of the present exemplary embodiment will be described below in detail referring to the flowchart of FIG. 15 (consisting of FIGS. 15A and 15B). The control based on this flowchart is performed by the controller 302 and other components described with reference to FIG. 4 according to a program stored in the memory 305.

First, when the buffer mode has been selected, and when the controller 302 receives a print instruction from a user (YES in step S800), the controller 302 determines whether the sheet to be printed can be stored in the storage device 200 of the normally-used image forming apparatus D. More specifically, in step S801, the controller 302 determines whether the number of sheets to be printed is less than or equal to a maximum number of sheets that can be stored in the storage device 200 upon reception of the print instruction. The user who has provided the print instruction in step S800 of FIG. 15 is hereinafter referred to as "user A". If the controller 302 determines that the number of sheets to be printed is less than or equal to the maximum number of sheets that can be stored (YES in step S801), then the processes that will be performed are similar to those illustrated in steps S502 to S507 of the first exemplary embodiment, and thus the description thereof will be omitted.

Figure 16:
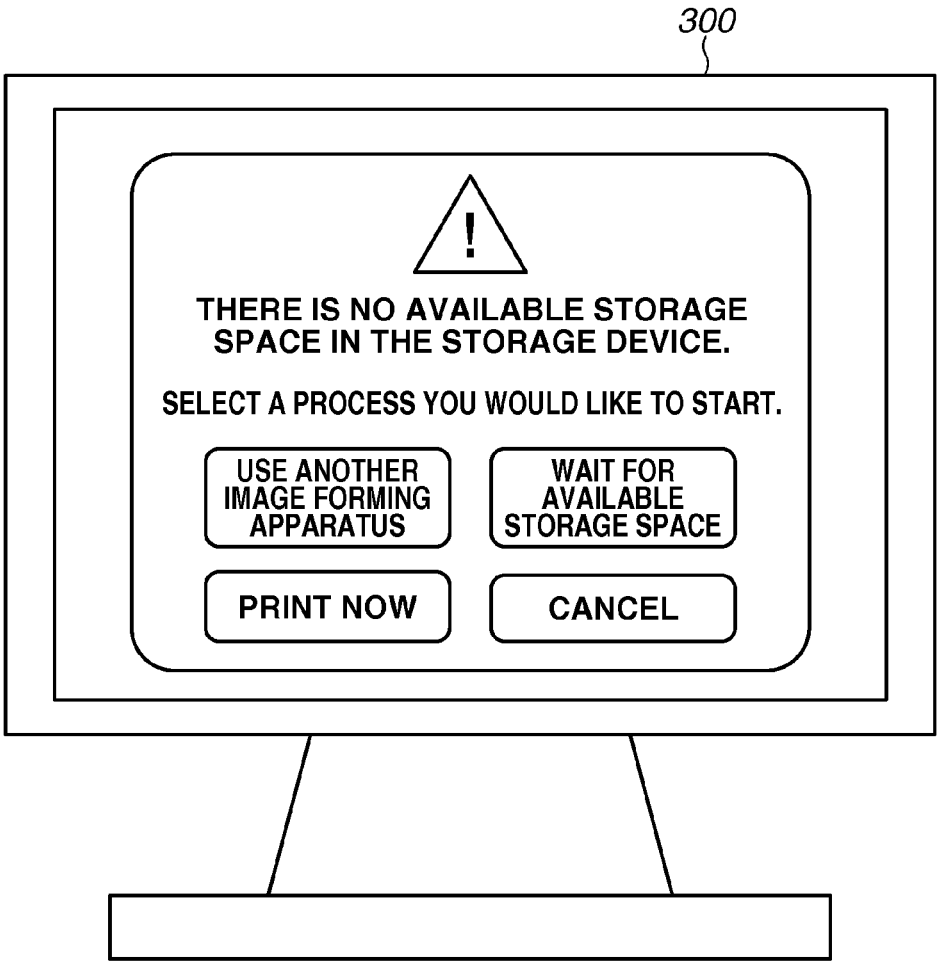
FIG. 16 is an example display on the external device according to the fourth exemplary embodiment.
Figure 17:
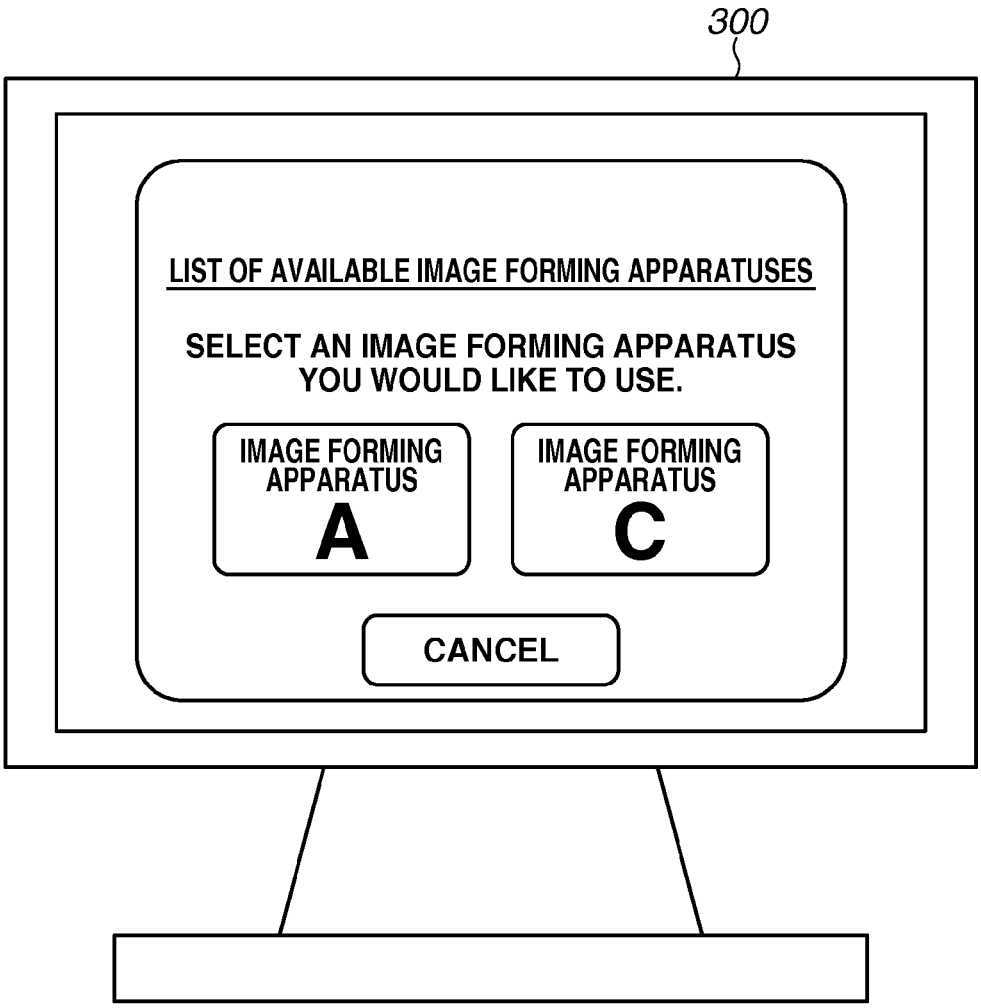
FIG. 17 is an example display on the external device according to the fourth exemplary embodiment.

On the other hand, in step S801, if the controller 302 determines that the number of sheets to be printed is larger than the maximum number of sheets that can be stored (NO in step S801), then in step S802, the controller 302 displays a message on a screen of the external device 300 of the user A informing that the storage device 200 has no available storage space. FIG. 16 illustrates an example screen thereof. The screen of FIG. 16 allows the user A to select using another image forming apparatus (A, B, or C), printing now to discharge the sheet to the discharge tray 124, or waiting for the storage device 200 becoming available (i.e., transition to the standby state of the first exemplary embodiment). The user A selects one of the options on this screen (YES in step S803). If the user A selects using another image forming apparatus A, B, or C, then in step S805, the controller 302 displays one or more image forming apparatuses having an available storage device 200, on the external device 300 of the user A. FIG. 17 illustrates an example screen thereof. The screen of FIG. 17 illustrates that the image forming apparatuses A and C each have available storage space, while the image forming apparatus B does not have available storage space. When the user A selects a desired image forming apparatus from the displayed image forming apparatuses (YES in step S806), printing is started in the selected image forming apparatus, and the sheet is then stored in a storage portion thereof in step S807. In step S808, if the user A selects, for example, the image forming apparatus A, the user A moves to the image forming apparatus A, and provides a discharge instruction. Similar to the image forming apparatus D, which includes the opening portion 250 and the operation display unit 307, the image forming apparatus A includes an opening portion 250 and an operation display unit 307, and thus the user A picks up the user A's own sheet through the opening portion 250 (steps S809 to S811).

On the other hand, in step S804, if the user A selects immediately printing and discharging the sheet to the discharge tray 124, then in step S812, the controller 302 of the image forming apparatus D performs control to start printing of the sheet of the user A. At this time, the discharge destination of the sheet is switched from the storage device 200 to the discharge tray 124. The printed sheets of the user A are sequentially discharged to the discharge tray 124. In step S813, before the sheet is discharged to the discharge tray 124, the controller 302 may display a message on a screen of the external device 300 of the user A informing that the sheet will be discharged to the discharge tray 124.

On the other hand, in step S804, if the user A selects a transition to a standby state, the controller 302 waits for storage space to become available in the storage device 200 of the image forming apparatus D. The processes that will be performed are similar to those illustrated in steps S508 to S515 of the first exemplary embodiment, and thus the description thereof will be omitted. In the present exemplary embodiment, the discharge instruction from the user A received by the controller 302 in step S513 is interpreted as an instruction to terminate the standby state, and the process is performed accordingly.

As described above, a configuration that allows selection of one image forming apparatus to be used from a plurality of image forming apparatuses enables the user to easily select an image forming apparatus having an available storage device 200, for example, in order of increasing distance from the user's desk. This improves usability.

In the exemplary embodiments described above, if the storage device 200 has no space to store sheets, the discharge destination of a sheet is switched to the discharge tray 124. However, the discharge destination of a sheet may be switched to the discharge tray 124 also when the sheet cannot be stored in the storage device 200, such as when a sheet stays in a portion downstream of the conveyance guide 128.

In the exemplary embodiments described above, an individual actuator is provided for each of the sheet-moving member 241 to 243 of the storage portions 221 to 223, and therefore simultaneous activation of these actuators enables the sheets stored in a plurality of storage portions to protrude in parallel. On the other hand, the image forming apparatus 100 may be configured to include less actuators than the number of storage portions, and to include driving-force transmission switching means, such as a clutch (not illustrated). This configuration enables a single actuator to selectively move the plurality of sheet-moving members 241 to 243.

In the exemplary embodiment described above, a part of the sheet S is protruded out of the image forming apparatus 100 through the opening portion 250 in response to the instruction of the user. However, the image forming apparatus 100 may be configured in such a manner that a tray is provided near the opening portion 250, and that the sheet S is moved by the sheet-moving means to discharge the entire sheet S to the tray.

In the exemplary embodiments described above, the memory 305 is included in the controller 302. However, the memory 305 may be provided in the engine control unit 303 or in the storage unit control unit 304, or may be individually provided in the image forming apparatus control unit 301.

In the exemplary embodiments described above, the image forming apparatus 100 is configured to include the engine control unit 303 and the storage unit control unit 304 separately, but may be configured to include only the engine control unit 303. In such a case, the engine control unit 303 should control the conveyance unit 105 and the storage device 200.

In the exemplary embodiments described above, the image forming apparatus 100 is configured in such a manner that the sheet conveyance paths merge downstream of the storage portions 221 to 223, and that only one opening portion 250 is provided, but may be configured to include a plurality of opening portions, and to protrude sheets stored in the storage portions 221 to 223 through the respective opening portions.

In the exemplary embodiments described above, the description has been made in terms of a configuration including three storage portions 221 to 223. However, the number of storage portions is not limited to three. The number of storage portions may be determined depending on the environment in which the apparatus main body is used, the number of users that share the apparatus, and/or the specifications of the apparatus main body.

In the exemplary embodiments described above, the storage device 200 is integrated with the image forming apparatus 100. However, the storage device 200 may be detachable from the image forming apparatus 100. In such a case, the control unit in the image forming apparatus 100 may control the operation of the storage device 200. Alternatively, an individual control unit may be provided in the storage device 200, and may control the operation in communication with the control unit in the image forming apparatus 100. The operation display unit 307 may be provided in the storage device 200.

Although, in the exemplary embodiments described above, an example of a laser beam printer is described, an image forming apparatus to which the present disclosure can be applied is not limited thereto, but may be a printer of other printing method, such as an ink jet printer, or a copying machine.

While the present disclosure has been described with reference to exemplary embodiments, it is to be understood that these exemplary embodiments are not seen to be limiting. The scope of the following claims is to be accorded the broadest interpretation so as to encompass all such modifications and equivalent structures and functions.

This application claims the benefit of Japanese Patent Application No. 2014-084714 filed Apr. 16, 2014 and No. 2015-050066 filed Mar. 12, 2015, which are hereby incorporated by reference herein in their entirety.

What is claimed is:

1. An image forming apparatus comprising:

an apparatus main body having an opening portion;

an image forming unit configured to form an image on a sheet;

a storage portion configured to store, inside the apparatus main body, the sheet on which the image has been formed;

a moving unit configured to move the sheet stored in the storage portion to protrude the sheet outside of the apparatus main body through the opening portion;

a stack portion configured to stack the sheet on which the image has been formed, and having been conveyed outside of the apparatus main body without passing through the storage portion;

a conveyance unit configured to convey the sheet on which the image has been formed to either the storage portion or the stack portion;

a receiving unit configured to receive an instruction from outside; and a control unit configured to cause the conveyance unit to convey the sheet on which the image has been formed to the storage portion in a case where the sheet is storable in the storage portion, and configured to shift to a standby state in which the receiving unit waits for a discharge instruction to discharge the sheet outside of the apparatus main body in a case where the sheet is not storable in the storage portion, and to cause the conveyance unit to convey the sheet on which the image has been formed to the stack portion when the receiving unit receives the discharge instruction during the standby state.

2. The image forming apparatus according to claim 1, wherein the case where the sheet is storable in the storage portion includes a case where the receiving unit receives an instruction to store a smaller number of sheets than a storable number of sheets in the storage portion, and wherein the case where the sheet is not storable in the storage portion includes a case where the receiving unit receives an instruction to store a larger number of sheets than the storable number of sheets in the storage portion.

3. The image forming apparatus according to claim 2, wherein the case where the sheet is storable in the storage portion includes a case where the receiving unit receives an instruction to store the smaller number of sheets in the storage portion in a state that none of sheets is stored in the storage portion, and wherein the case where the sheet is not storable in the storage portion includes a case where the receiving unit receives an instruction to store the larger number of sheets in the storage portion in a state that none of sheets is stored in the storage portion.

4. The image forming apparatus according to claim 2, wherein the case where the sheet is storable in the storage portion includes a case where the receiving unit receives an instruction to store a smaller number of a second group of sheets than the storable number of sheets in the storage portion in a state that a first group of sheets is stored in the storage portion, and wherein the case where the sheet is not storable in the storage portion includes a case where the receiving unit receives an instruction to store a larger number of the second group of sheets than the storable number of sheets in the storage portion in a state that the first group of sheets is stored in the storage portion.

5. The image forming apparatus according to claim 2, further comprising a selection unit configured to select, upon receipt of the instruction to store the larger number of sheets in the storage portion by the receiving unit, whether to allow the control unit to shift to the standby state, convey the sheet to the stack portion, or convey a part of the larger number of sheets to the storage portion.

6. The image forming apparatus according to claim 4, wherein, in the case where the receiving unit receives the instruction to store the larger number of the second group of sheets in the storage portion, the control unit shifts to the standby state, wherein, in a case where the receiving unit receives the discharge instruction to discharge the first group of sheets in the standby state, the control unit causes the moving unit to move the first group of sheets and protrude the first group of sheets outside of the apparatus main body through the opening portion, and wherein, in a case where the receiving unit receives the discharge instruction to discharge the second group of sheets in the standby state, the control unit causes the conveyance unit to convey the second group of sheets to the stack portion.

7. The image forming apparatus according to claim 1, wherein the case where the sheet is storable in the storage portion includes a case where no sheet is retained on a conveyance path from the conveyance unit to the storage portion, and wherein the case where the sheet is not storable in the storage portion includes a case where a sheet is retained on the conveyance path.

8. The image forming apparatus according to claim 1, further comprising a selection unit configured to select, upon receipt of an instruction to store the sheet in the storage portion by the receiving unit, whether to allow the control unit to shift to the standby state or convey the sheet to the stack portion.

9. The image forming apparatus according to claim 1, further comprising a notification unit configured to notify, in a case where a conveyance destination of the sheet is switched to the stack portion, that a switch has occurred.

10. The image forming apparatus according to claim 1, wherein the moving unit moves the sheet stored in the storage portion and stops the sheet in a protruded state in which a part of the sheet protrudes outside of the apparatus main body through the opening portion.

11. An image forming system comprising:

a plurality of image forming apparatuses according to claim 1; and a selection unit configured to select, upon receipt of an instruction to store the sheet to a storage portion of a first image forming apparatus from among the plurality of image forming apparatuses by a receiving unit of the first image forming apparatus, whether to allow a control unit of the first image forming apparatus to shift to the standby state, convey the sheet to a stack portion of the first image forming apparatus, or use a second image forming apparatus from among the plurality of the image forming apparatuses that is different from the first image forming apparatus.

12. An image forming apparatus comprising:

an apparatus main body having an opening portion;

an image forming unit configured to form an image on a sheet;

a storage portion configured to store, inside the apparatus main body, the sheet on which the image has been formed;

a moving unit configured to move the sheet stored in the storage portion to protrude the sheet outside of the apparatus main body through the opening portion;

a stack portion configured to stack the sheet on which the image has been formed, and having been conveyed outside of the apparatus main body without passing through the storage portion;

a conveyance unit configured to convey the sheet on which the image has been formed to either the storage portion or the stack portion;

a receiving unit configured to receive an instruction from outside; and a control unit configured to cause the conveyance unit to convey a second group of sheets on which the image has been formed to the storage portion in a case where a first group of sheets is not stored in the storage portion, and configured to shift to a standby state in which the receiving unit waits for a discharge instruction to discharge the sheet outside of the apparatus main body in a case where the first group of sheets is stored in the storage portion, and to cause the conveyance unit to convey the second group of sheets on which the image has been formed to the stack portion when the receiving unit receives the discharge instruction of the second group of sheets during the standby state.

13. The image forming apparatus according to claim 12, wherein in the case where the receiving unit receives the discharge instruction of the first group of sheets in the standby state, the control unit causes the moving unit to move the first group of sheets and protrude the first group of sheets outside of the apparatus main body through the opening portion.

14. The image forming apparatus according to claim 13, wherein the control unit causes the conveyance unit to convey the second group of sheets on which the image has been formed to the storage portion when the first group of sheets are removed from of the apparatus main body, and causes the moving unit to move the second group of sheets and protrude the second group of sheets outside of the apparatus main body through the opening portion in a case where the receiving unit receives the discharge instruction to discharge the second group of sheets.

15. The image forming apparatus according to claim 12, further comprising a selection unit configured to select, upon receipt of an instruction to store the second group of sheets in the storage portion by the receiving unit, whether to allow the control unit to shift to the standby state or convey the second group of sheets to the stack portion.

16. The image forming apparatus according to claim 12, further comprising a selection unit configured to select, upon receipt of an instruction to store the second group of sheets in the storage portion by the receiving unit, whether to allow the control unit to shift to the standby state, convey the second group of sheets to the stack portion, or convey a part of the second group of sheets to the storage portion.

17. The image forming apparatus according to claim 12, further comprising a notification unit configured to notify, in a case where a conveyance destination of the second group of sheets is switched to the stack portion, that a switch has occurred.

18. The image forming apparatus according to claim 12, wherein the moving unit moves the sheet stored in the storage portion and stops the sheet in a protruded state in which a part of the sheet protrudes outside of the apparatus main body through the opening portion.

19. An image forming system comprising:

a plurality of image forming apparatuses according to claim 12; and a selection unit configured to select, upon receipt of an instruction to store the second group of sheets to a storage portion of a first image forming apparatus from among the plurality of image forming apparatuses by a receiving unit of the first image forming apparatus, whether to allow a control unit of the first image forming apparatus to shift to the standby state, convey the second group of sheets to a stack portion of the first image forming apparatus, or use a second image forming apparatus from among the plurality of the image forming apparatuses that is different from the first image forming apparatus.

* * * * *